US010189250B2

(12) United States Patent
Yamato

(10) Patent No.: US 10,189,250 B2
(45) Date of Patent: Jan. 29, 2019

(54) PRINTHEAD, ELEMENT SUBSTRATE, AND PRINTING APPARATUS

(71) Applicant: CANON KABUSHIKI KAISHA, Tokyo (JP)

(72) Inventor: Hidenori Yamato, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/692,205

(22) Filed: Aug. 31, 2017

(65) Prior Publication Data

US 2018/0086050 A1 Mar. 29, 2018

(30) Foreign Application Priority Data

Sep. 27, 2016 (JP) ..... 2016-188751

(51) Int. Cl.

| | |
|---|---|
| ***B41J 2/07*** | (2006.01) |
| ***B41J 2/045*** | (2006.01) |
| ***B41J 25/34*** | (2006.01) |
| ***B41J 2/14*** | (2006.01) |
| ***B41J 2/155*** | (2006.01) |
| ***B41J 2/21*** | (2006.01) |

(52) U.S. Cl.

CPC ..... *B41J 2/0455* (2013.01); *B41J 2/04541* (2013.01); *B41J 2/04548* (2013.01); *B41J 2/14* (2013.01); *B41J 2/155* (2013.01); *B41J 2/2146* (2013.01); *B41J 25/34* (2013.01); *B41J 2/04591* (2013.01); *B41J 2002/14491* (2013.01); *B41J 2202/19* (2013.01); *B41J 2202/20* (2013.01)

(58) Field of Classification Search

USPC ..... 347/49, 54, 206

See application file for complete search history.

(56) References Cited

U.S. PATENT DOCUMENTS

| | | | | |
|---|---|---|---|---|
| 6,068,367 A * | 5/2000 | Fabbri | B41J 2/14024 347/49 |
| 7,448,727 B2 * | 11/2008 | Rai | B41J 2/14233 347/206 |
| 9,044,956 B2 | 6/2015 | Silverbrook et al. | |
| 2005/0156981 A1 | 7/2005 | Silverbrook et al. | |

FOREIGN PATENT DOCUMENTS

| | | |
|---|---|---|
| JP | 2010-012795 A | 1/2010 |

* cited by examiner

*Primary Examiner* — Lam Nguyen
(74) *Attorney, Agent, or Firm* — Venable LLP

(57) ABSTRACT

A printhead, comprises: a plurality of element substrates that each include a first element substrate adjacent to a second element substrate in a first direction, wherein a first print element array arranged in the first element substrate includes a first print element that is closest to the second element substrate in the first direction, and a second print element array arranged in the second element substrate includes a second print element closest to the first element substrate in the first direction, and an order of arrangement in the second direction of at least the first print element and a first driving circuit corresponding to the first print element is opposite to an order of arrangement in the second direction of the second print element and a second driving circuit corresponding to the second print element.

14 Claims, 31 Drawing Sheets

PRINTHEAD, ELEMENT SUBSTRATE, AND PRINTING APPARATUS

BACKGROUND OF THE INVENTION

Field of the Invention

The present invention is related to a printhead, element substrate, and printing apparatus.

Description of the Related Art

In recent years, full-line printheads, in which a plurality of print element substrates are arranged across a print width, and that perform printing in a single pass for commercial use and industrial use have spread. In Japanese Patent Laid-Open No. 2010-012795, an arrangement is such that there is an offset orthogonal to an orifice array direction at connecting parts between adjacent print element substrates. In addition, there is a configuration in which print element substrates are arrayed in a straight line by orifice arrays being offset orthogonally in a print element substrate. Also, there is a configuration in which two print element substrates are adjacently arranged to lengthen the print length (print width) of one printing pass even when not considering a single pass head. By an arrangement in which the connecting part of a print element substrate is set to a shape having an angle as described above, it is possible to have the distance between orifices at a connecting part between adjacent print element substrates be smaller than in the case in which print element substrates are arrayed in a staggered manner.

FIG. 4A illustrates a comparative example of a configuration in a printhead where two print element substrates are arranged adjacently. In FIG. 4A and FIG. 4B, let the downward direction be the positive x direction, and the upward direction be the negative x direction. In addition, let the rightward direction be the positive y direction, and the leftward direction be the negative y direction. Assume also that a printing medium is conveyed in the positive x direction. A plurality of orifice arrays are arrayed in a print element substrate 101 (and 102), and a print element is arranged with respect to each orifice. Each print element is connected to a corresponding driving circuit. Here, illustration is given of an example of three arrays. When the connecting part of the print element substrates is a shape that has an angle (for example, the side of a parallelogram as illustrated in FIG. 4A), when one connecting part is seen from the same y-coordinate, a furthest end print element 202 is arranged near an edge of a print element substrate 102. In addition a driving circuit 302 that corresponds to the furthest end print element 202 is arranged further in the positive x direction than the furthest end print element 202. However, at the other connecting part, when seen from the same y-coordinate, a driving circuit 301 that corresponds to a furthest end print element 201 is arranged between the furthest end print element 201 and the end of the print element substrate 101. Therefore, at the other connecting part, the distance between the furthest end print element 201 and the edge of the print element substrate 101 lengthens in proportion to the width of the driving circuit 301. As a result, it is not possible to shorten the distance (the distance of the bidirectional arrow symbol in FIG. 4B) between the furthest end print elements 201 and 202 that form a connection between the print element substrates.

FIG. 4B is a view that expands the connecting part in FIG. 4A. For the print element substrates 101 and 102 which have an angle at the connecting parts, an autogenous air flow occurs in a direction of the arrow that follows the shape of the connecting parts. With respect to the print direction (the positive x direction), the air flow is strong at an upstream end of the print element substrate 101, and the air flow is weak at a downstream end of the print element substrate 102. Because of this a difference occurs in deviation of ink landing positions between the upstream print element substrate 101 and the downstream print element substrate 102. When the printing speed is made to be high this difference becomes noticeable, and thus there is a need to cause the furthest end print elements 201 and 202 which form the connection between print element substrates to be as close as possible. In addition, at a time of high-speed printing, making the distance between furthest end print elements close and suppressing landing position deviation even when the printing medium is conveyed diagonally with respect to an orifice array is needed now more than ever.

SUMMARY OF THE INVENTION

The present invention was conceived to solve the aforementioned problem and, by causing orifices to be close to an end of a print element substrate, can suppress landing deviation due to air flow and reduce ink landing position deviation when a printing medium is conveyed diagonally.

According to one aspect of the present invention, there is provided a printhead, comprising: a plurality of element substrates that each include a first element substrate adjacent to a second element substrate in a first direction, wherein the first element substrate and the second element substrate each have a print element array in which a plurality of print elements are arrayed in the first direction, and a driving circuit array in which a plurality of driving circuits that respectively correspond to the plurality of print elements are arrayed, the print element array and the driving circuit array being arranged in a second direction that intersects with the first direction, a first print element array arranged in the first element substrate includes a first print element that is closest to the second element substrate in the first direction, and a second print element array arranged in the second element substrate includes a second print element closest to the first element substrate in the first direction, and an order of arrangement in the second direction of at least the first print element and a first driving circuit corresponding to the first print element is opposite to an order of arrangement in the second direction of the second print element and a second driving circuit corresponding to the second print element.

According to another aspect of the present invention, there is provided an element substrate, comprising: a print element array in which a plurality of print elements are arrayed in a first direction; and a driving circuit array in which a plurality of driving circuits respectively corresponding to the plurality of print elements are arrayed, wherein the print element array and the driving circuit array are arranged in a second direction that intersects with the first direction, wherein a planar shape of the element substrate is a quadrilateral that has a first side, a second side, a third side that is parallel to the first side, an acute angle portion between the first side and the second side, and an obtuse angle portion between the second side and the third side, a print element, out of the print elements included in the print element array, closest to the second side in the first direction is arranged on a side of the obtuse angle portion in the second direction, and a driving circuit corresponding to the print element closest to the second side is arranged on a side of the acute angle portion in the second direction.

According to another aspect of the present invention, there is provided a printing apparatus, comprising: a conveying unit configured to convey a printing medium; and a printhead configured to print an image to the printing medium, wherein the printhead has a plurality of element substrates including a first element substrate adjacent to a second element substrate in a predetermined direction that intersects with a conveyance direction in which the printing medium is conveyed, wherein the first element substrate and the second element substrate each have a print element array in which a plurality of print elements are arrayed in the predetermined direction, and a driving circuit array in which a plurality of driving circuits that respectively correspond to the plurality of print elements are arrayed, the print element array and the driving circuit array being arranged in the conveyance direction, a first print element array arranged in the first element substrate includes a first print element that is closest to the second element substrate in the predetermined direction, and a second print element array arranged in the second element substrate includes a second print element closest to the first element substrate in the predetermined direction, and an order of arrangement in the conveyance direction of at least the first print element and a first driving circuit corresponding to the first print element is opposite to an order of arrangement in the conveyance direction of the second print element and a second driving circuit corresponding to the second print element.

By virtue of the present invention, it is possible to shorten the distance between furthest end print elements that form a connection between print element substrates, and an image quality is improved.

Further features of the present invention will become apparent from the following description of exemplary embodiments (with reference to the attached drawings).

DESCRIPTION OF THE EMBODIMENTS

Figure 1:
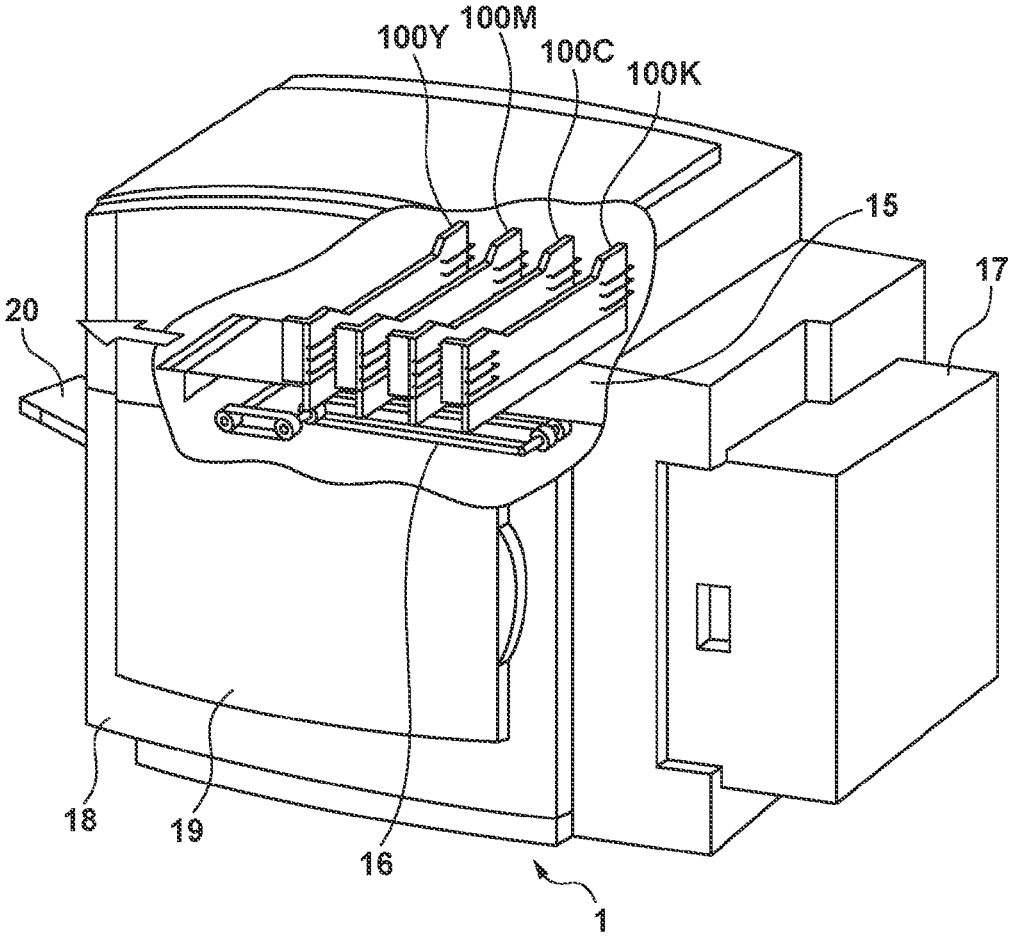
FIG. 1 is an external perspective view illustrating an example of a configuration of an inkjet printing apparatus.

Below, more specific descriptions are given in detail of preferred embodiments of the present invention, with reference to the attached drawings. However, relative arrangements of configuration components, and the like that are recited in the present embodiment are not intended to limit the scope of the invention thereto, unless specifically stated.

Note that in this specification, "printing" ("print") encompasses forming not only meaningful information such as characters and shapes, but also meaningless information. Furthermore, it is assumed that "print" broadly encompasses cases in which an image or pattern is formed on a printing medium irrespective of whether or not it is something that a person can visually perceive, as well as cases in which a medium is processed.

Also, "printing medium" broadly is assumed to represent not only paper used in a typical printing apparatus, but also things that can receive ink such as cloths, plastic films, metal plates, glass, ceramics, wood materials, hides or the like.

Furthermore, similarly to the foregoing definition of "printing (print)", "ink" (also referred to as "liquid") should be broadly interpreted. Accordingly, "ink" is assumed to represent liquids that by being applied to a printing medium can be supplied in the forming of images, patterns or the like, processing of printing mediums, or processing of ink (for example, insolubilization or freezing of a colorant in ink applied to a printing medium).

Furthermore, it is assumed that "printing component", unless specified otherwise, encompasses an orifice and an element that produces energy that is used for discharge of ink and a fluid channel that communicates therewith collectively.

Furthermore, it is assumed that "nozzle", unless specified otherwise, encompasses an orifice and an element that produces energy that is used for discharge of ink and a fluid channel that communicates therewith collectively.

An element substrate for a printhead (a head substrate) referred to below does not indicate a simple substrate comprising a silicon semiconductor, but indicates a configuration of a print element substrate in which elements, wiring, or the like is provided.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that respective elements are formed and manufactured integrally on the element board by a semiconductor circuit manufacturing process.

For an inkjet printhead (hereinafter referred to as printhead) having the most important features of the present invention, on an element substrate of a printhead, a plurality of print elements and a driving circuit that drives these print elements are implemented on the same substrate. As will be clear from the following explanation, a plurality of element substrates are integrated in a printhead, and these element substrates have a cascade connection structure. Accordingly, this printhead is able to achieve a print width that is relatively long. Accordingly, this printhead is used not only in common serial type printing apparatus, but also in a printing apparatus comprising a full-line printhead whose print width corresponds to the width of the printing medium. Also, this printhead is also used in large format printers that use printing mediums of a large size such as AO and B0 in serial type printing apparatuses.

Accordingly, firstly, a printing apparatus in which the printhead of the present invention is used is described.

[Printing Apparatus Overview Description]

FIG. 1 is a perspective view for describing a structure of a printing apparatus 1 comprising a recovery unit for ensuring continuously stable ink discharge for full-line inkjet printheads (hereinafter referred to as printheads) 100K, 100C, 100M, and 100Y.

In the printing apparatus 1, a printing sheet 15 is supplied to a print position according to a printhead from a feeder unit 17, and is conveyed by a conveying unit 16 comprised in a housing 18 of the printing apparatus.

In printing of an image to the printing sheet 15, black ink is discharged from a printhead 100K when a nominal position of the printing sheet 15 reaches a position below the printhead 100K for discharging black (K) ink while the printing sheet 15 is being conveyed. Similarly, a color image is formed by discharging each color of ink when the printing sheet 15 reaches each nominal position in order of the printhead 100C for discharging cyan (C) ink, the printhead 100M for discharging magenta (M) ink, and the printhead 100Y for discharging yellow (Y) ink. The printing sheet 15 on which an image is printed in this way is discharged and deposited to a stacker tray 20.

The printing apparatus 1 further comprises the conveying unit 16, and a replaceable ink cartridge (not shown) for each ink for supplying ink to the printheads 100K, 100C, 100M, and 100K. Also, it comprises a pump unit (not shown) for supplying ink to the printheads 100 and a recovery operation and a control substrate (not shown) for controlling the printing apparatus 1 as a whole. Also, a front door 19 is an opening/closing door for replacing an ink cartridge.

[Control Configuration]

Next, description is given for a control configuration for executing print control of a printing apparatus explained by using FIG. 1.

Figure 2:
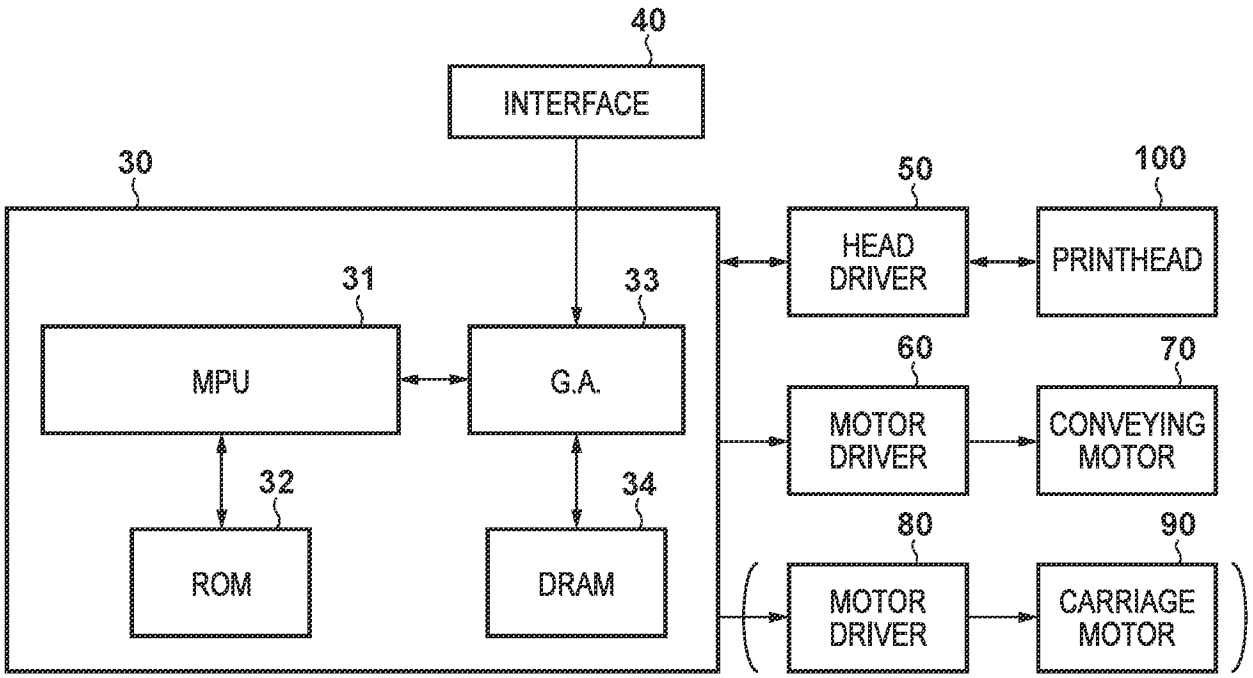
FIG. 2 is a view illustrating an example of a control configuration of the inkjet printing apparatus according to the present application invention.

FIG. 2 is a block diagram illustrating a configuration of a control circuit of the printing apparatus. In FIG. 2, a controller 30 is configured to include an MPU 31, a ROM 32, a gate array (G.A.) 33, and a DRAM 34. An interface 40 is an interface for inputting printing data. The ROM 32 is a non-volatile storage region, and stores control programs that the MPU 31 executes. The DRAM 34 is a DRAM that saves data such as printing data and a printing signal supplied to the printhead 100. The gate array 33 is a gate array that performs control for supplying a printing signal to the printhead 100, and performs data transfer control between the interface 40, the MPU 31, and the DRAM 34. A carriage motor 90 is a motor for conveying the printhead 100 (100K, 100C, 100M, and 100Y). A conveying motor 70 is a motor for print paper conveyance. A head driver 50 drives the printhead 100. Motor drivers 60 and 80 are motor drivers for driving the conveying motor 70 and the carriage motor 90 respectively.

Note that in a printing apparatus of a configuration using a full-line printhead as illustrated in FIG. 1, the carriage motor 90 and a motor driver 80 for driving that motor are not present. Accordingly, in FIG. 2, they are surrounded by parentheses.

To explain operation of the foregoing control configuration, printing data is converted into a printing signal for printing between the gate array 33 and the MPU 31 when the printing data is entered into the interface 40. Also, in addition to the motor drivers 60 and 80 being driven, the printhead 100 is driven in accordance with printing data sent to the head driver 50, and printing is performed.

In the example explained below, although explanation is given with a full-line printhead as an example, there is no limitation to this, and application may be made to a printhead of a serial type printing apparatus as described above.

[A Conventional Configuration Printhead]

Figure 17A:
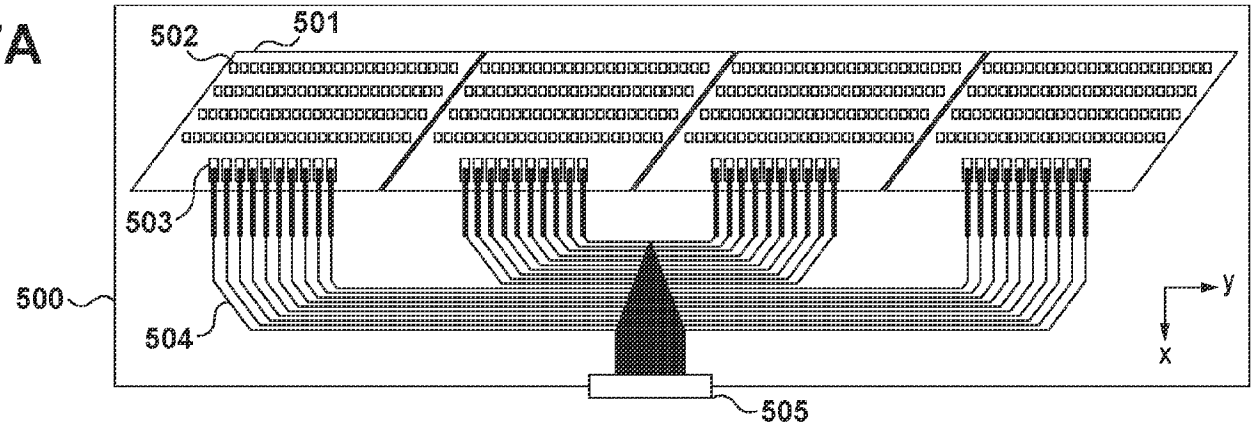
FIGS. 17A and 17B are views illustrating an example of a configuration of a printhead according to a conventional example.
Figure 17B:
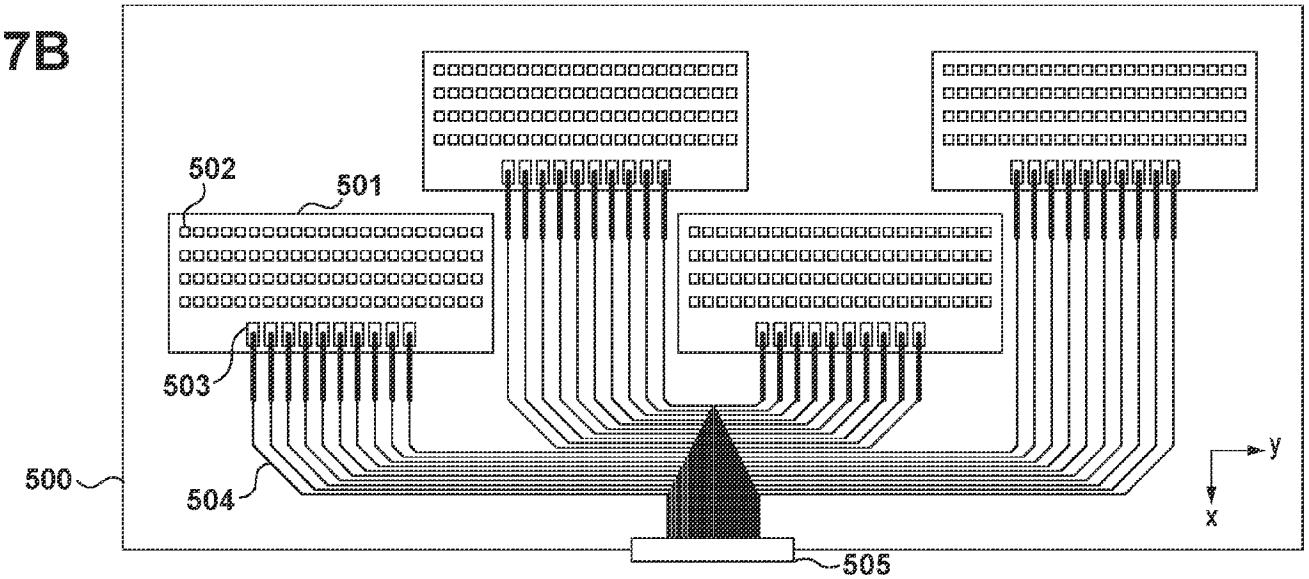

An example of a printhead configuration is illustrated in FIGS. 17A and 17B. To a printhead 500, signals are transmitted and power is supplied from a printing apparatus (not shown) to a connector 505, which is connected to each print element substrate 501 via a printhead wire 504. Here, explanation will be given by giving an example of the printhead 500 which has four print element substrates 501. An orifice 502 is arrayed across plurality of arrays (in this case four arrays) in the print element substrate 501. In a printhead configuration in which the print element substrates 501 are lined up in a straight line as in FIG. 17A, it is possible to make the distance between the orifices at a connecting part between adjacent print element substrates 501 be closer in comparison to a configuration in which the print elements are arrayed in a staggered manner (FIG. 17B). For this reason, in the configuration of FIG. 17A, a printhead width (x direction) can be smaller and the entirety of the printhead can be made smaller.

In FIGS. 17A and 17B, let the downward direction be a positive x direction, and let the upward direction be a negative x direction. In addition, let the rightward direction be the positive y direction, and the leftward direction be the negative y direction. Assume that the printing medium is conveyed in the positive x direction. In the configuration of FIG. 17A, even if the conveyance of a printing medium is diagonal with respect to the printheads, it is possible to reduce ink landing position deviation because the distance between orifices that are connected between adjacent print element substrates 501 is small.

First Embodiment

Figure 3A:
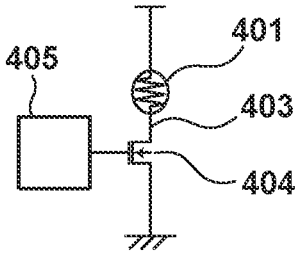
FIGS. 3A, 3B and 3C are examples of configurations and layout views of print elements and driving circuits according to a first embodiment.
Figure 3B:
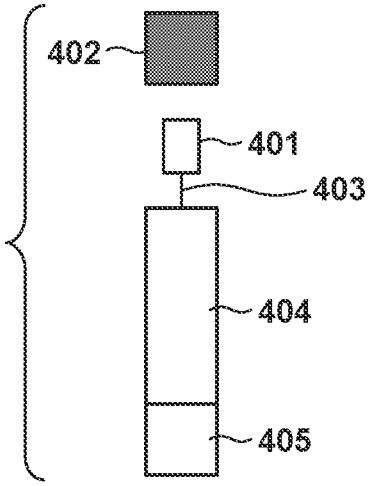
Figure 3C:
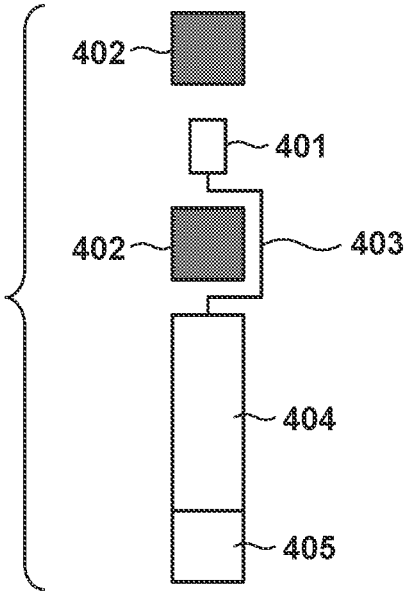

FIGS. 3A to 3C illustrate an example of a layout and example configurations of a print element and a print element driving circuit according to the first embodiment of the present invention. In FIG. 3A, a print element 401 is connected via a wiring line 403 to a MOS transistor 404 that switches driving of the print element 401. A supply port 402 supplies ink to the print element 401, and is arranged adjacent to the print element 401. In FIG. 3B, a single supply port 402 is arranged with respect to a single print element 401. Note that, as in FIG. 3C, configuration may be taken such that a total of two supply ports 402 are arranged on the two sides of one of the print element 401. A print element selection circuit 405 is connected to the MOS transistor 404, and ON/OFF of the MOS transistor 404 is controlled by a print element selection signal being sent from the print element selection circuit 405. By this a current flows to a desired print element 401, and by the energy thereof, ink supplied from the supply port 402 is discharged to a printing medium.

The print element selection circuit 405 includes a circuit for sending a print element selection signal (for example, a shift register and a latch circuit), wiring for transferring the signal, wiring for supplying power, or the like. In addition, the print element selection circuit 405 may include a voltage conversion circuit for converting a voltage inputted to the MOS transistor 404. Here, the MOS transistor 404 and the print element selection circuit 405 are collectively referred to as a print element driving circuit (hereinafter, a driving circuit).

Figure 4A:
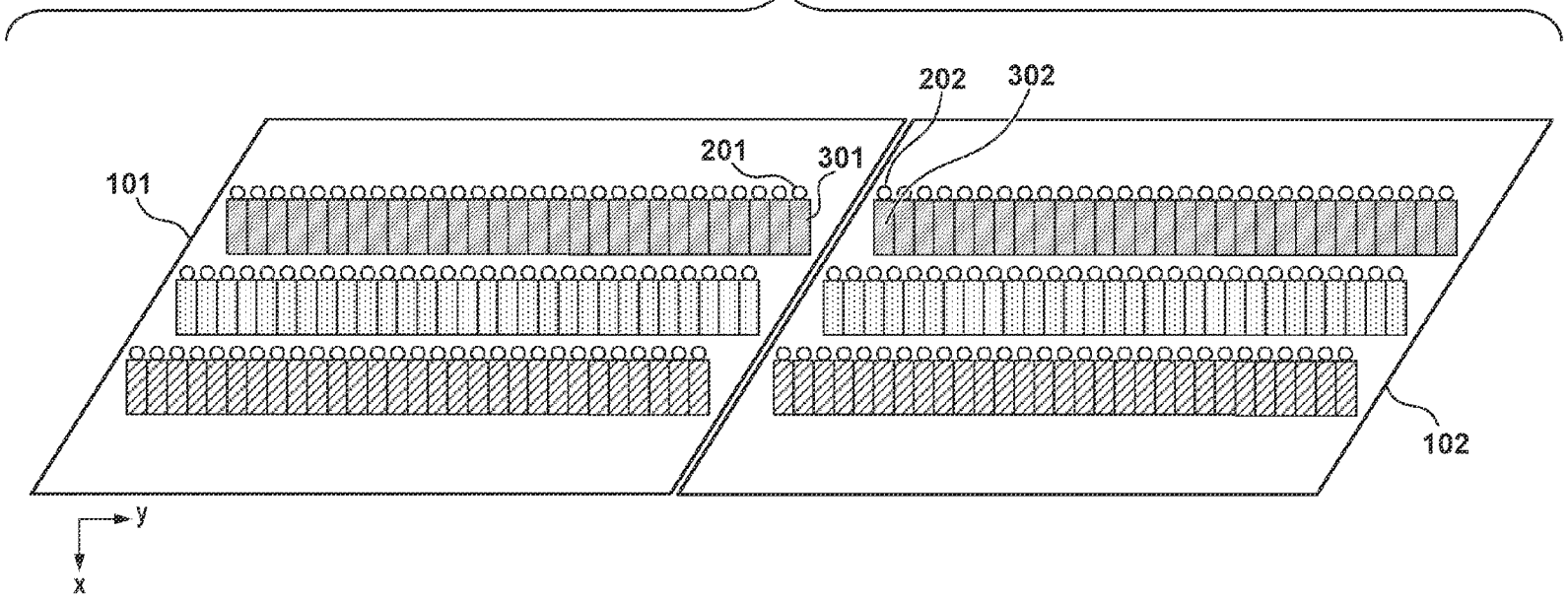
FIGS. 4A and 4B are views illustrating a comparative example of the printhead according to a conventional example.
Figure 4B:
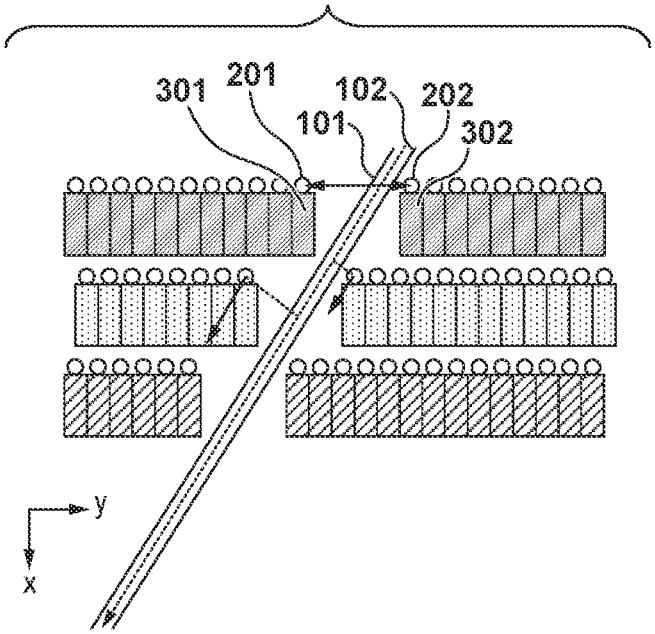
Figure 5A:
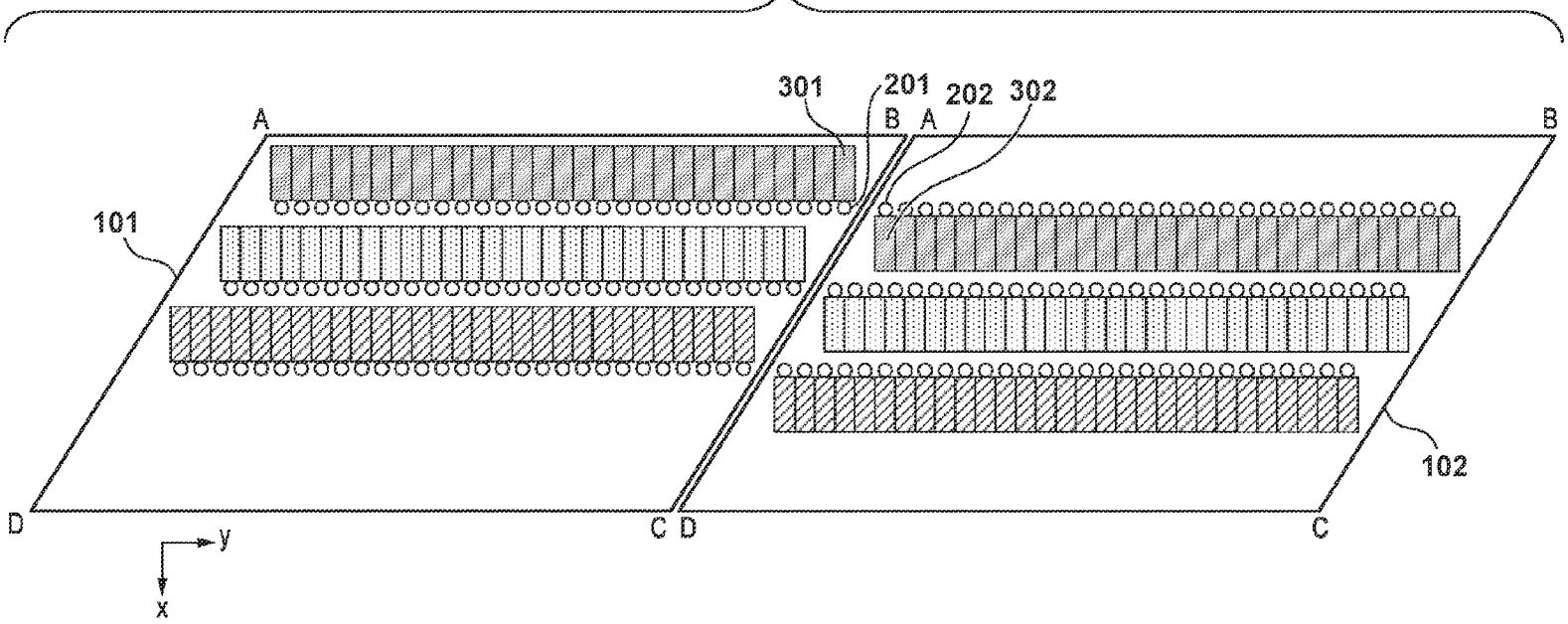
FIGS. 5A and 5B are views illustrating an example of a configuration of a printhead according to the first embodiment.
Figure 5B:
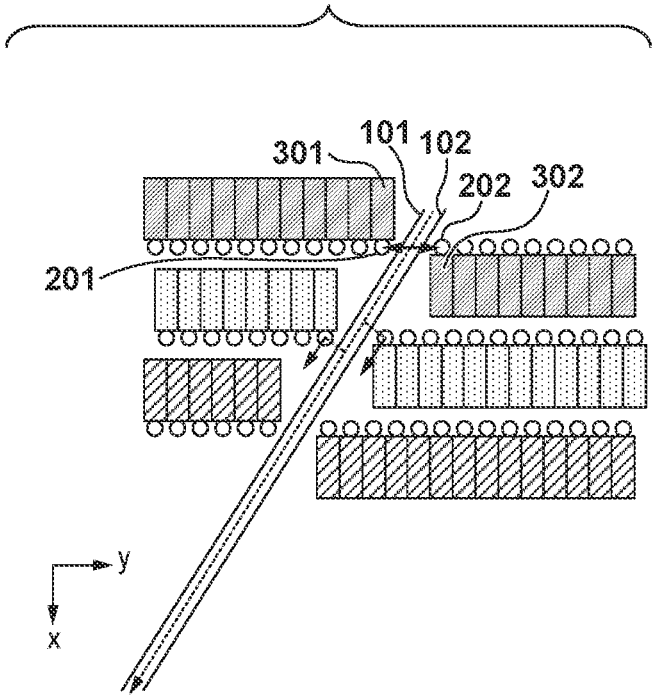

FIG. 5A illustrates an example of a configuration of a printhead according to the first embodiment. In addition, FIG. 5B is a view that enlarges connecting parts of the print element substrates, out of the configuration of the printheads. In FIG. 5A and FIG. 5B, similarly to in FIG. 4A and FIG. 4B, let the downward direction be the positive x direction, and the upward direction be the negative x direction. In addition, let the rightward direction be the positive y direction, and the leftward direction be the negative y direction. Assume also that a printing medium is conveyed in the positive x direction. In other words, the x direction is the conveyance direction of a printing medium. The shape of the print element substrates 101 and 102 is a parallelogram, and these are arranged adjacently in the y direction. For the print element substrates 101 and 102, as illustrated in FIG. 5A, an angle A and an angle C are obtuse angles, and an angle B and an angle D are acute angles. In a parallelogram ABCD, the side AB and the side CD are parallel, and the side BC and the side DA are parallel. A print element is provided in association with each of a respective plurality of orifices. It is assumed below that an orifice and a print element are at the same position, and in order to simplify the explanation, the supply port is not shown. In the example of FIG. 5A and FIG. 5B, three arrays of print elements are arrayed in the x direction with an interval of the resolution of the printing apparatus (for example, 600 dpi).

Adjacent print element arrays in the print element substrate are arranged so as to be shifted by a total amount of a multiple of the print element interval and half of the print element interval. In FIG. 5A and FIG. 5B, they are arranged to be shifted in the y direction by a distance of 2.5 times the width of a print element. In other words, because an adjacent portion (side) of a print element substrate forms an inclination with respect to the x direction, if print elements are arranged on the end along the side, a shift occurs in arrangement positions. A corresponding driving circuit is connected to each of a plurality of print elements, and ink is caused to be discharged onto a printing medium by causing the driving circuit to operate. The furthest end print element 201 on the right end (positive y axis side) of the print element substrate 101 and the furthest end print element 202 on the left end (negative y axis side) of the print element substrate 102 form a connection in the image between adjacent print element substrates.

In the print element substrate 101, a print element array is arrayed in a straight line in the y direction. In addition, all driving circuits are arranged in a negative x direction with respect to a corresponding print element. In the print element substrate 102, a print element array is also arrayed in a straight line in the y direction. However, all driving circuits are arranged in a positive x direction with respect to a corresponding print element. Because of this, on the right end (positive y axis side) of the print element substrate 101, because the driving circuit 301 is arranged more in the negative x direction than the furthest end print element 201 that forms the connection between print element substrates, it is possible to make the furthest end print element 201 closer to the end of the print element substrate. Similarly, on the left end (negative y axis side) of the print element substrate 102, because the driving circuit 302 arranged more in the positive x direction than the furthest end print element 202, it is possible to make the furthest end print element 202 be closer to the end of the print element substrate. Next, explanation will be given about a positional relationship of the print element 201 and the driving circuit 301 corresponding to the print element 201 with respect to an angle B and an angle C in the print element substrate 101. The print element 201 is arranged on the side of the angle C (an obtuse angle) for the x direction, and the driving circuit 301 is arranged on the side of the angle B (an acute angle) for the x direction. Next, explanation about a positional relationship of the print element 202 and the driving circuit 302 corresponding to the print element 202 with respect to an angle A and an angle D in the print element substrate 102 will be given. The print element 202 is arranged on the side of the angle A (an obtuse angle) for the x direction, and the driving circuit 302 is arranged on the side of the angle C (an obtuse angle) for the x direction. As described above, an order of arrangement in the x direction for the print element 201 and the driving circuit 301 is opposite to the order of arrangement in the x direction for the print element 202 and the driving circuit 302.

Note that there is no need for the arrangement of a MOS transistor and a print element selection circuit in the driving circuit 301 corresponding to the furthest end print element 201 to be the same as the arrangement of a MOS transistor and a print element selection circuit in the driving circuit 302 corresponding to the furthest end print element 202. In a case of arranging two print element substrates adjacent to each other, because the left end of the print element substrate 101 and the right end of the print element substrate 102 do not form a connection, configuration may be taken to not cause a print element be close to an end of the print element substrate.

By this configuration, it is possible to have the furthest end print element 201 and the furthest end print element 202 which form a connection between print element substrates be closer by an amount of a driving circuit, in comparison to the connecting parts of the comparative example illustrated in FIG. 4A and FIG. 4B. By this, an ink landing position deviation amount due to air flow at a time of printing is reduced, and it is also possible to suppress landing position deviation even if a printing medium is conveyed diagonally with respect to a print element array.

Figure 6A:
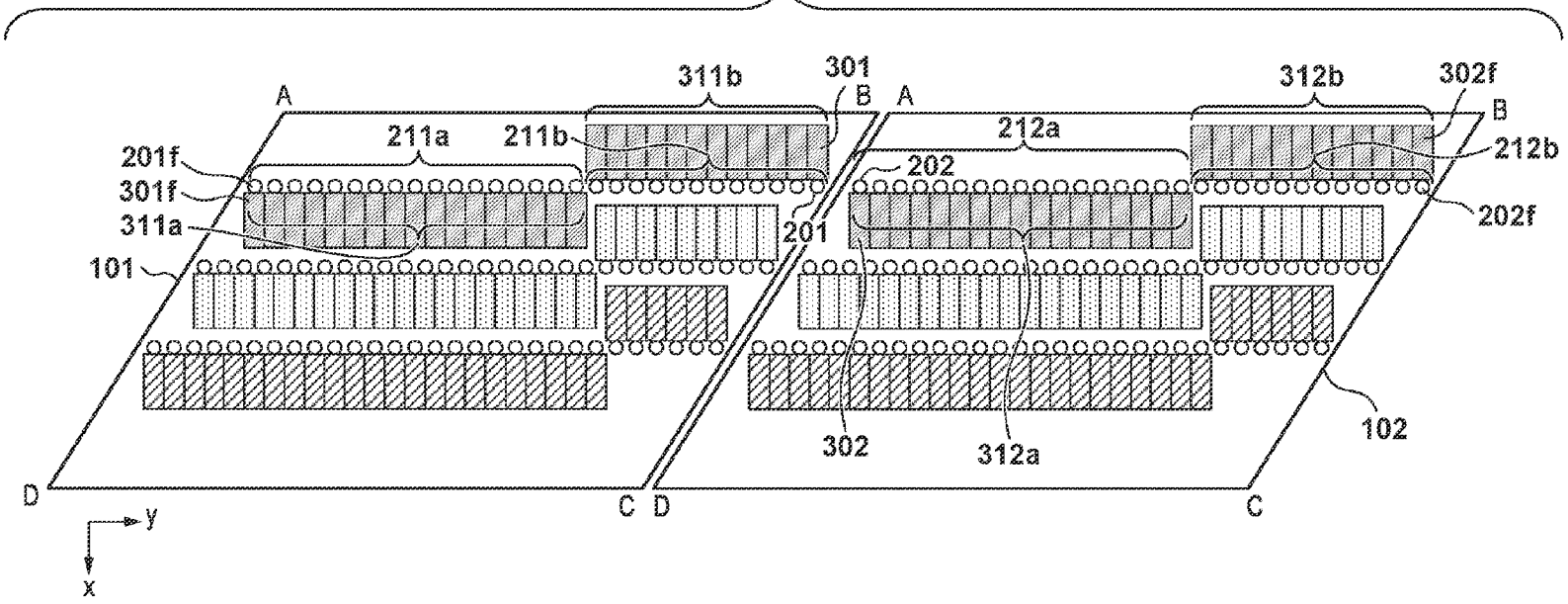
FIGS. 6A and 6B are views illustrating another example of a configuration of the printhead according to the first embodiment.
Figure 6B:
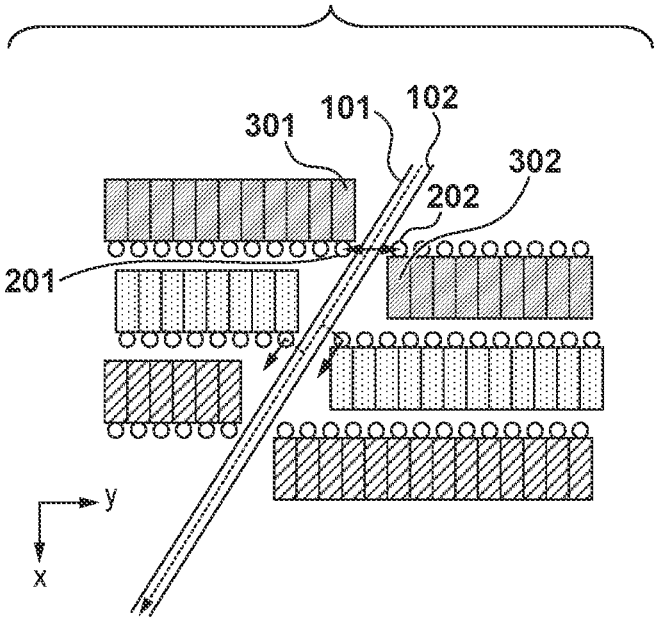

FIG. 6A and FIG. 6B illustrate a different example of a configuration in a print element substrate according to the present embodiment. A configuration that is the same as that of FIG. 5A and FIG. 5B is denoted by the same reference numeral, and explanation thereof is omitted. In FIG. 6A and FIG. 6B, a driving circuit group 311*a* that corresponds to a print element group 211*a* is arranged more on a positive x axis side than a print element, and a driving circuit group 311*b* that corresponds to a print element group 211*b* is arranged more on a negative x axis side than a print element. A driving circuit group 312*a* that corresponds to a print element group 212*a* is arranged more on a positive x axis side than a print element, and a driving circuit group 312*b* that corresponds to a print element group 212*b* is arranged more on a negative x axis side than a print element. In the print element substrate 101, the driving circuit 301 corresponding to the print element 201 closest to the print element substrate 102 in the y direction out of the print element groups 211*a* and 211*b* is arranged on the side of the angle B (acute angle) in the x direction. In contrast, a driving circuit 301*f* that corresponds to a print element 201*f* that is farthest from the print element substrate 102 in the y direction out of the print elements included in the print element groups 211*a* and 211*b* is arranged on a side of the angle D (acute angle) in the x direction. In the print element substrate 102, the driving circuit 302 corresponding to the print element 202 closest to the print element substrate 101 out of the print element groups 212*a* and 212*b* is arranged on the side of the angle D (acute angle) in the x direction. In contrast, a driving circuit 302*f* that corresponds to a print element 202*f* that is farthest from the print element substrate 101 out of the print elements included in the print element groups 212*a* and 212*b* is arranged on a side of the angle B (acute angle) in the x direction. Here, the print elements are arranged in a straight line in the y direction, and there is no change from the positions of the print elements illustrated in FIG. 5A and FIG. 5B. In other words, in the print element substrate 101 and the print element substrate 102, corresponding print elements are arranged in a line in the y direction so that offsetting does not occur.

In this configuration, in an array comprising a print element array and a corresponding driving circuit array, there is a portion in which the positional relationship of the arrangement of some of the print elements and the driving circuits is caused to be reversed. In other words, the positional relationship of print elements and driving circuits positioned at least at the furthest end of the array is opposite to the positional relationship of print elements and driving circuits on an adjacent print element substrate side.

By this configuration, on the right end (positive y axis side) of the print element substrate 101, because the driving circuit 301 is arranged more in the negative x direction than the furthest end print element 201 that forms the connection between print element substrates, it is possible to make the furthest end print element 201 closer to the end of the print element substrate. Similarly, on the left end (negative y axis side) of the print element substrate 102, because the driving circuit 302 is arranged more in the positive x direction than the furthest end print element 202, it is possible to make the furthest end print element 202 be closer to the end of the print element substrate. In other words, by this different configuration example, it is also possible to obtain a similar effect to that of FIG. 5B. In this way, by changing the arrangement of driving circuits in a print element substrate, it is possible to shorten the distance between furthest end print elements at connecting parts even if two or more print element substrates are arrayed.

Second Embodiment

Figure 7A:
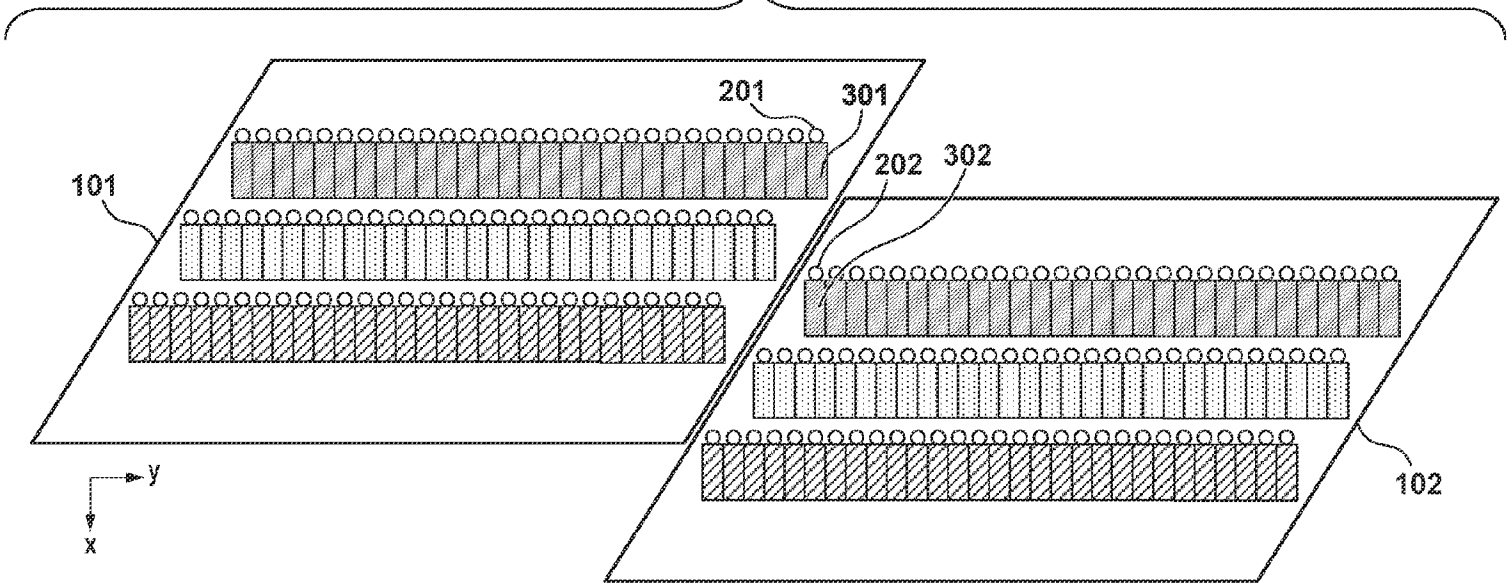
FIGS. 7A and 7B are views illustrating a comparative example of the printhead according to a conventional example.
Figure 7B:
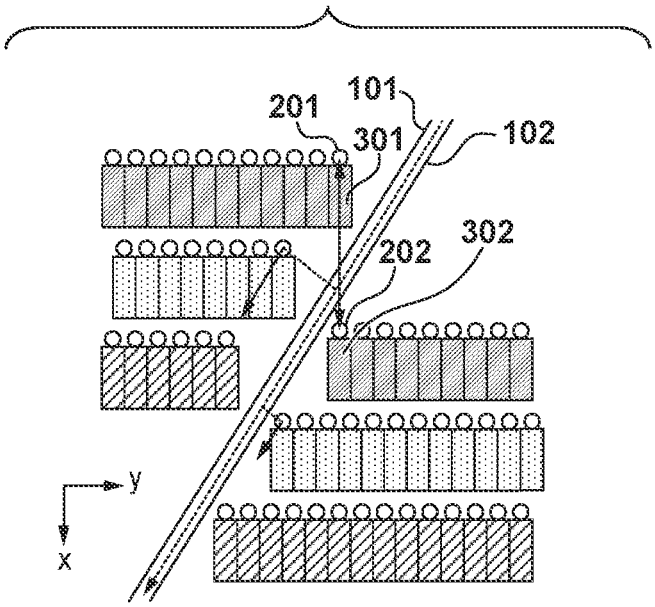

Explanation is given below regarding a second embodiment of the present application invention. FIG. 7A illustrates a comparative example, as a conventional technique, of a configuration in a printhead where two print element substrates are arranged adjacently. A configuration that is the same as that of FIG. 5A and FIG. 5B is denoted by the same reference numeral, and explanation thereof is omitted. As illustrated in FIG. 7A and FIG. 7B, the furthest end print elements 201 and 202 are arranged at the same y-coordinate, and form a connection. The print element substrate 101 and the print element substrate 102 are arrayed to be offset in the x direction. In such a configuration, the distance between the furthest end print element 201 and the furthest end print element 202 is longer by the amount of the width of the driving circuit 301 (in the x direction).

Figure 8A:
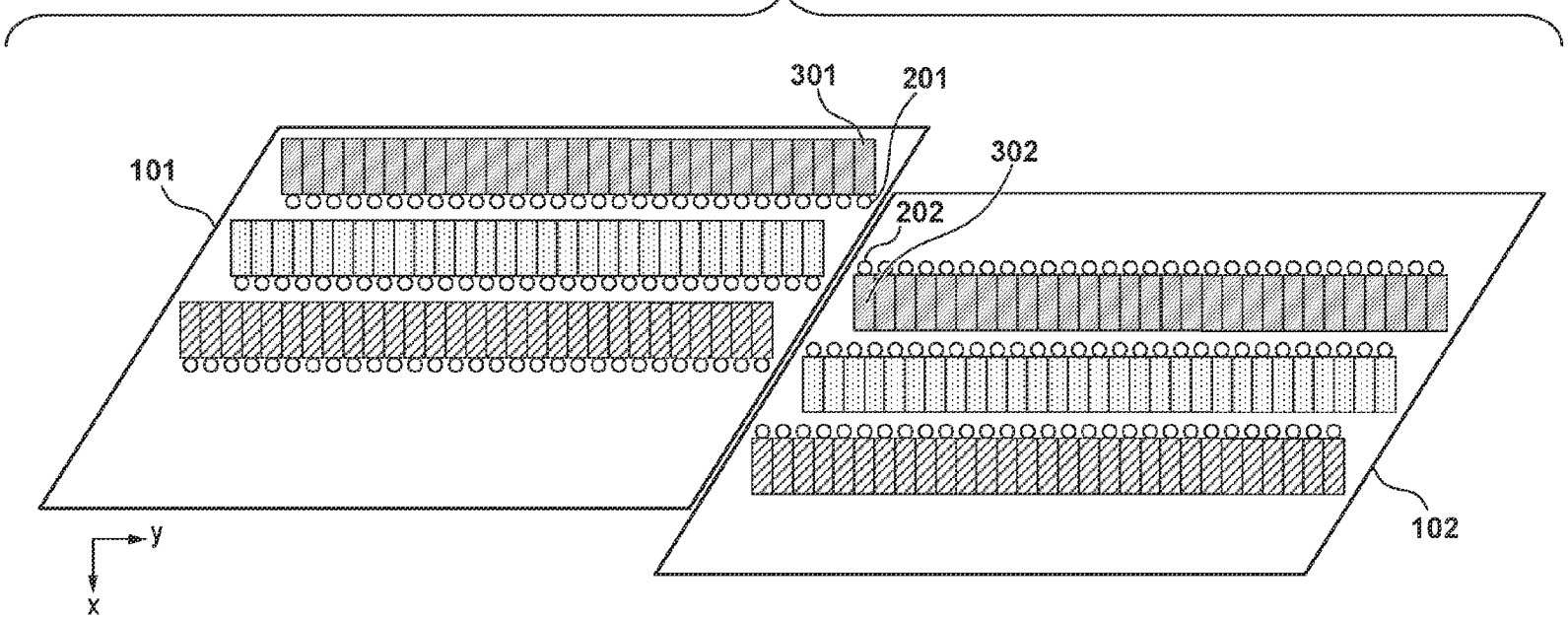
FIGS. 8A and 8B are views illustrating an example of a configuration of a printhead according to a second embodiment.
Figure 8B:
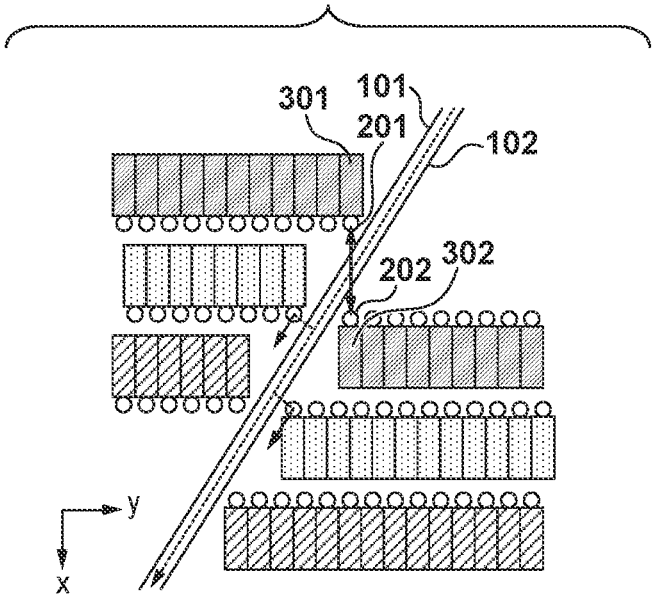

In contrast, FIG. 8A illustrates an example of a configuration of a printhead according to the second embodiment of the present invention. In addition, FIG. 8B is a view that enlarges connecting parts of the print element substrates, out of the configuration of the printheads. Similarly to the first embodiment (FIG. 5A and FIG. 5B), in the print element substrate 101 a print element array is arrayed in a straight line in the y direction in a print element substrate. In addition, all driving circuits are arranged in a negative x direction with respect to a corresponding print element. Whereas, in the print element substrate 102, the print element array is also arrayed in a straight line in the y direction in the print element substrate. However, all driving circuits are arranged in a positive x direction with respect to a corresponding print element. In addition, similarly to FIG. 5B, the furthest end print element 201 and the furthest end print element 202 are arranged on a straight line in the x direction.

By this configuration, it is possible to have the furthest end print element 201 and the furthest end print element 202 which form a connection between print element substrates be closer by an amount for a driving circuit, in comparison to the connecting parts of the comparative example illustrated in FIG. 7A and FIG. 7B. By this, an ink landing position deviation amount due to air flow at a time of printing is reduced, and it is also possible to suppress landing position deviation even if a printing medium is conveyed diagonally with respect to a print element array.

Figure 9A:
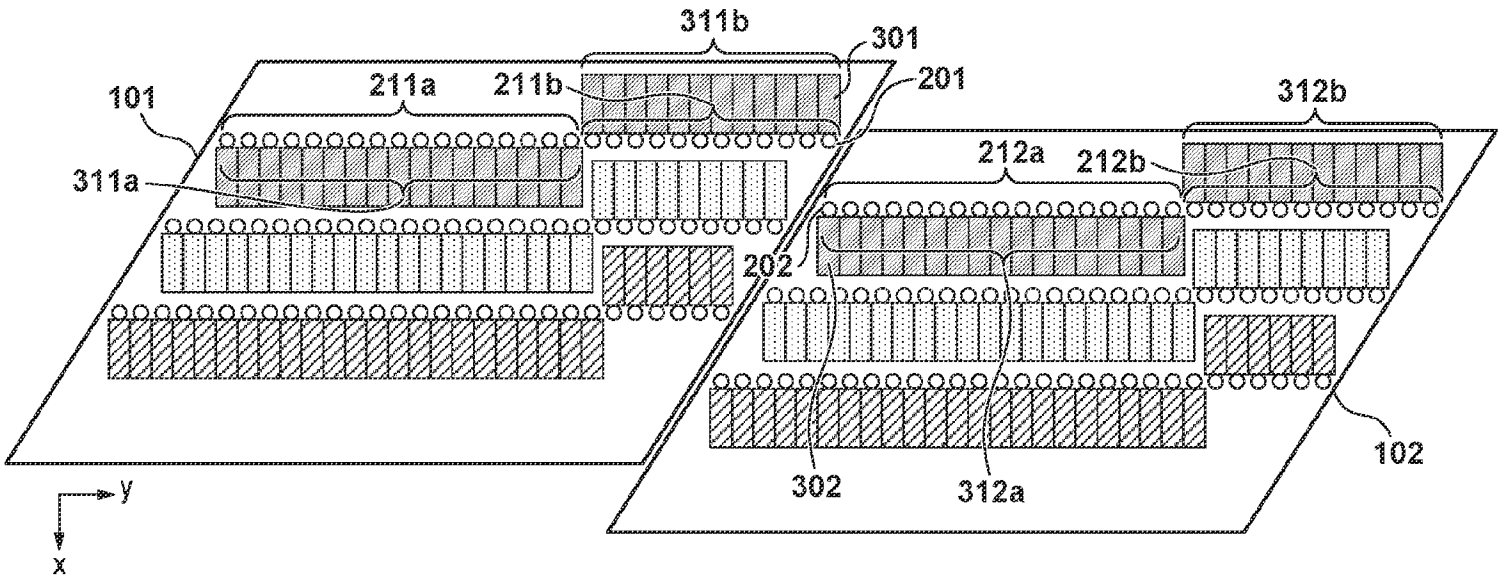
FIGS. 9A and 9B are views illustrating another example of a configuration of the printhead according to the second embodiment.
Figure 9B:
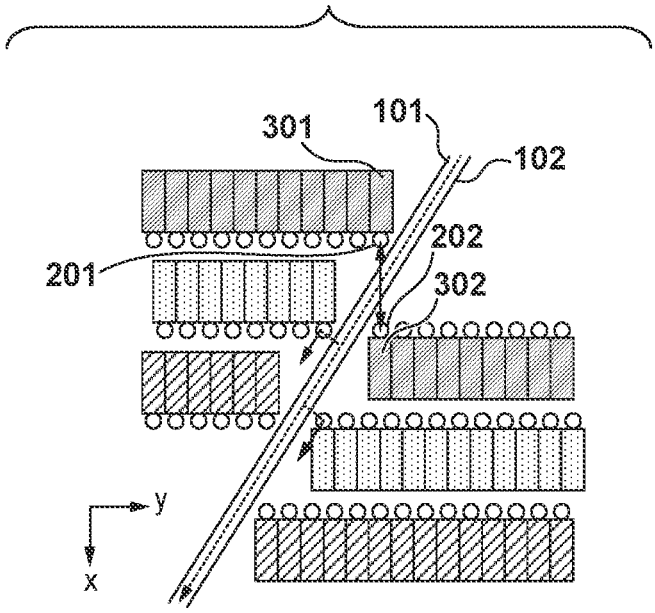

The configuration illustrated in FIG. 8A and FIG. 8B is an example in the present embodiment, and the shape of the print element substrate, the number of print elements, and the number of arrays is not limited to the configuration of FIG. 8A and FIG. 8B. For example, the configuration may be taken in which a furthest end print element is made closer to the end of the print element substrate by arranging a portion of the driving circuit group in reverse in a print element substrate as in FIG. 9A and FIG. 9B. In the example of FIG. 9A and FIG. 9B, adjacent print element arrays deviate in the y direction by a total amount of a multiple of the print element interval and half of the print element interval (the distance of 2.5 times a print element interval in FIG. 9A and FIG. 9B), and a reversed position of the driving circuit group deviates by a distance of half of the print element interval in the y direction. Even with this configuration, it is possible to obtain a similar effect to that of FIG. 8A and FIG. 8B.

Figure 10:
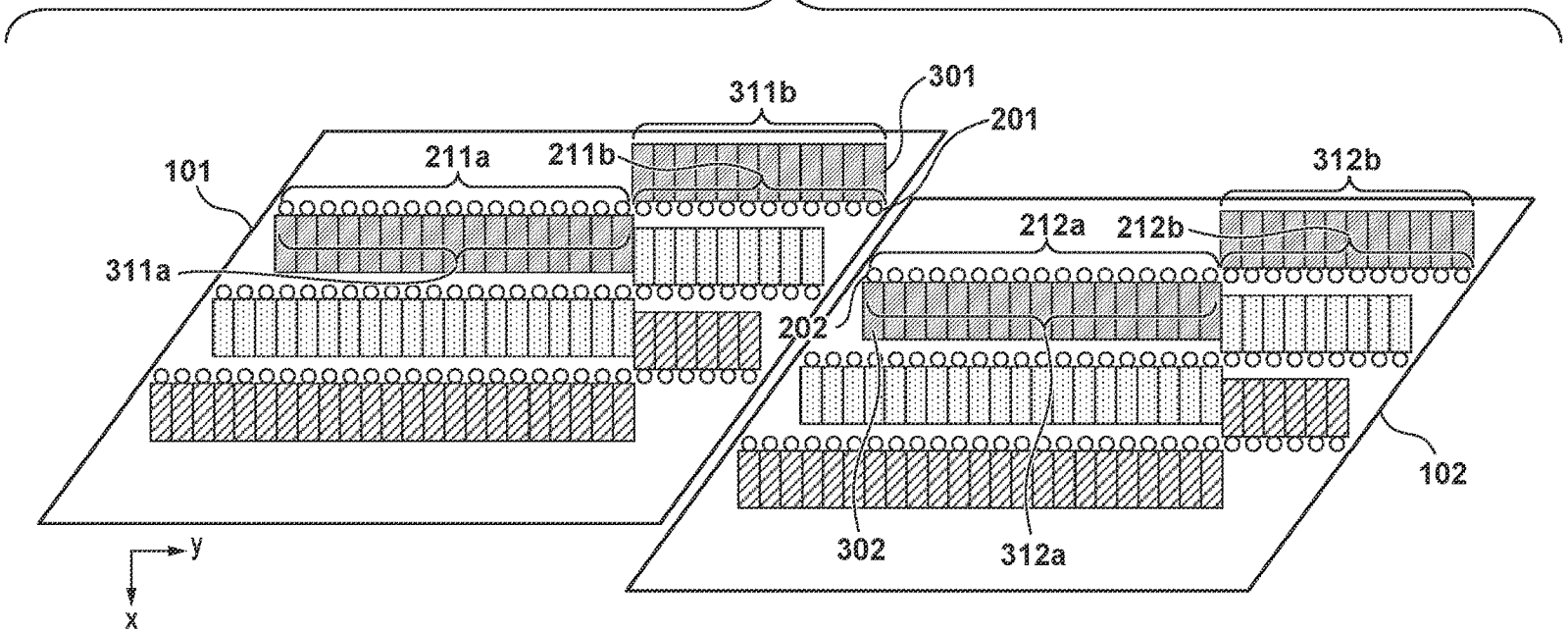
FIG. 10 is a view illustrating another example of a configuration of the printhead according to the second embodiment.

In addition, even if adjacent print element arrays are arranged to be shifted in the y direction by a multiple of a print element interval as in FIG. 10 (a distance of three times the print element interval in FIG. 10), it is similarly possible to arrange a driving circuit group in reverse and have a furthest end print element be close to the end of a print element substrate. In the example of FIG. 10, a reversal position for a driving circuit group is equal to a direction perpendicular to the print element array (the y-coordinate is the same). Even with this configuration, it is possible to obtain a similar effect to that of FIG. 8A and FIG. 8B.

Figure 11:
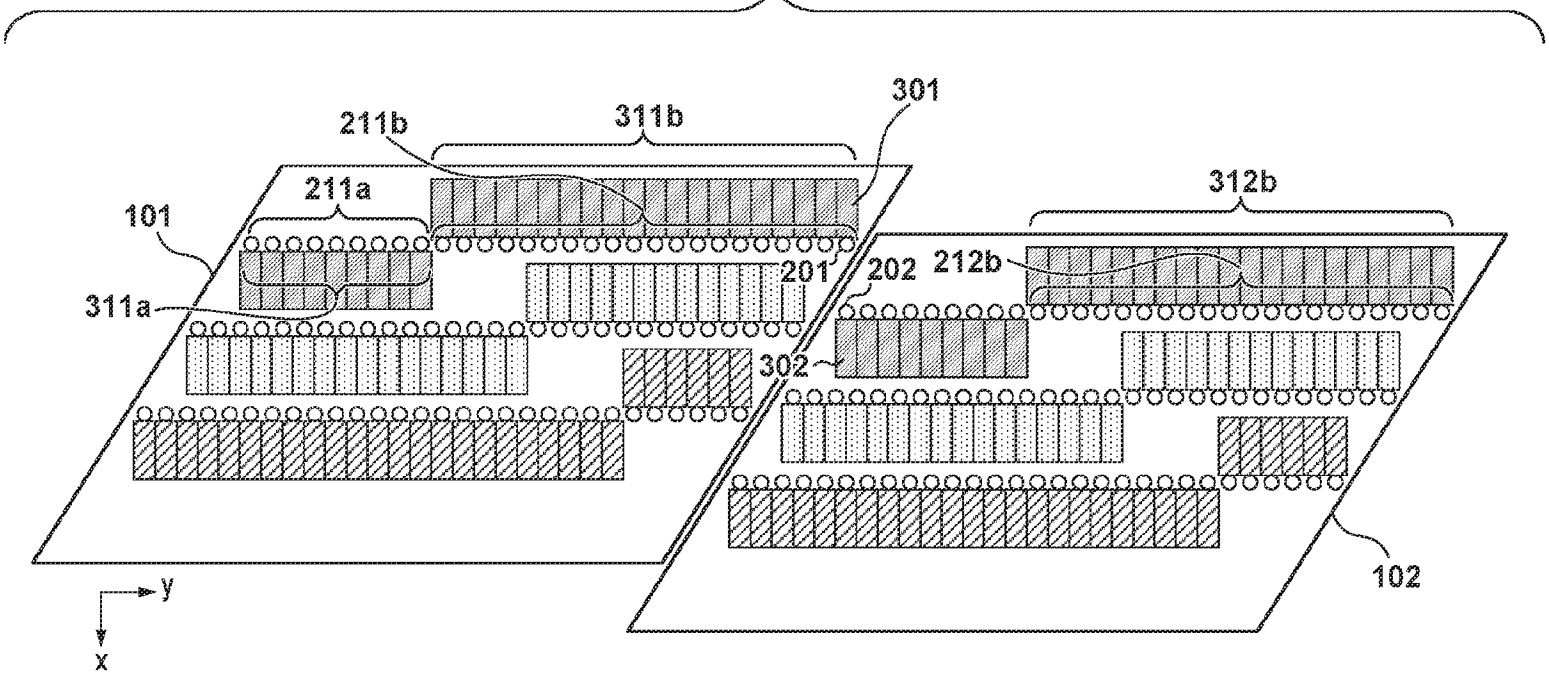
FIG. 11 is a view illustrating another example of a configuration of the printhead according to the second embodiment.

In addition, configuration may be taken so as to change the position of reversal of a driving circuit group between print element arrays as in FIG. 11. Accordingly, there are advantages in that it becomes easier to separate circuits between print element arrays, another function circuit may be inserted into an open space, and so on. Here, configuration may be taken to set the number of print elements and driving circuits for which positions are reversed to be the same in each array.

Figure 12:
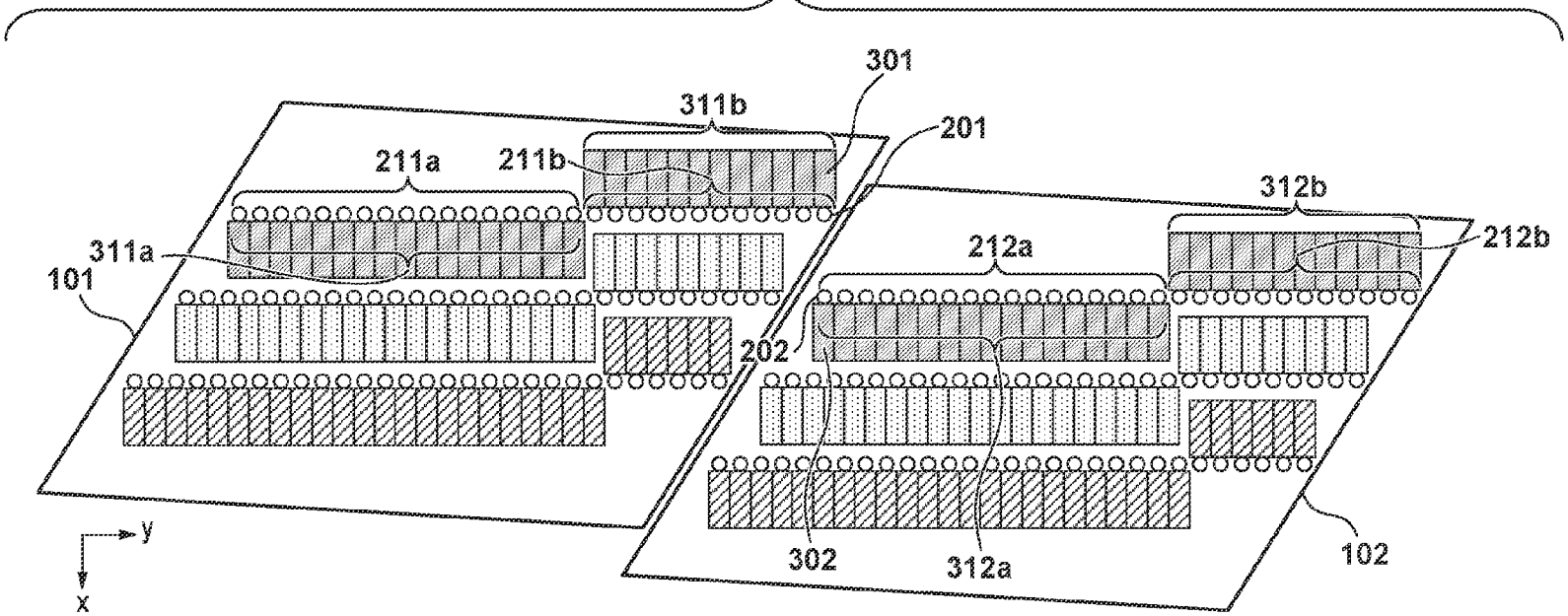
FIG. 12 is a view illustrating another example of a configuration of the printhead according to the second embodiment.

In addition, the present embodiment can also be applied in the case in which an end face of a print element substrate and the direction of a print element array are not parallel, as in FIG. 12.

Figure 13:
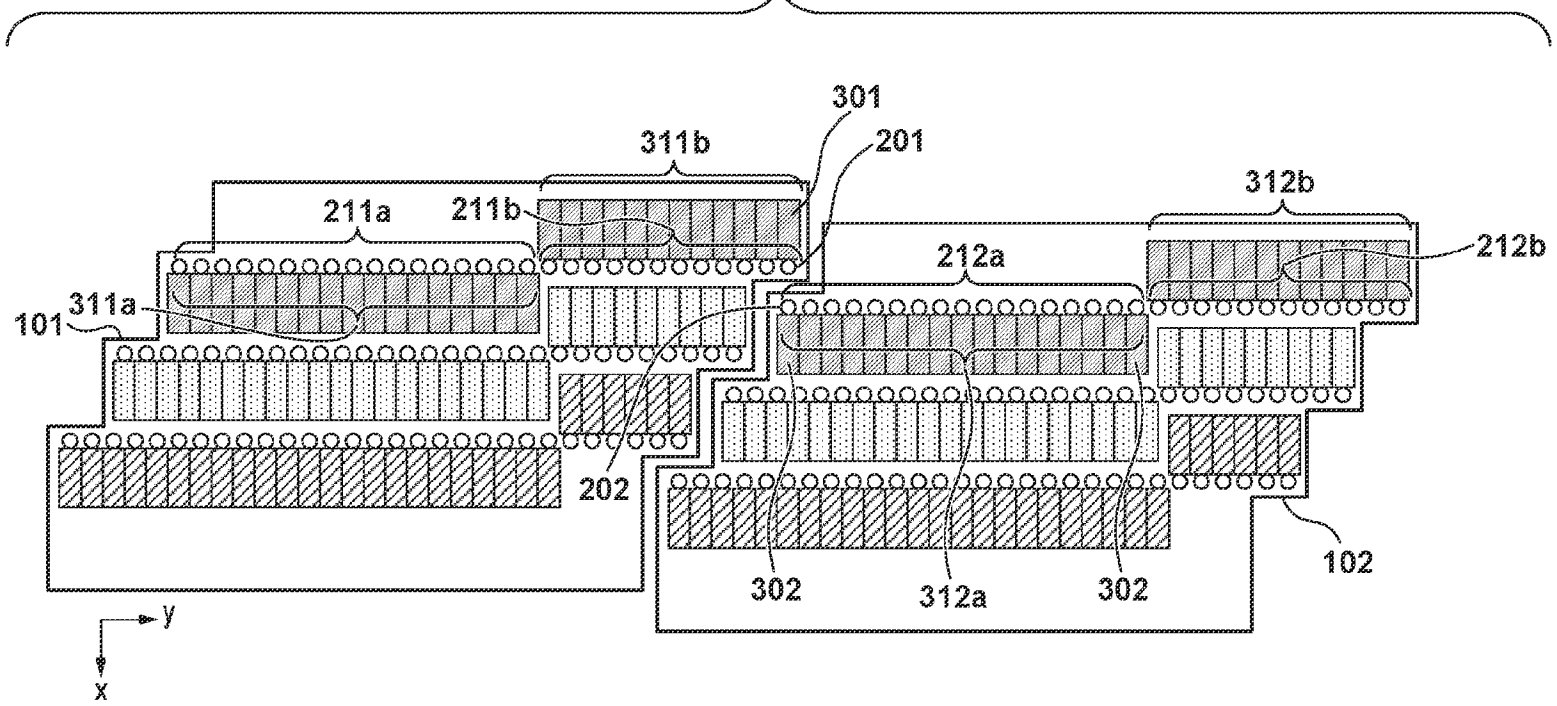
FIG. 13 is a view illustrating another example of a configuration of the printhead according to the second embodiment.

In addition, the shape of a print element substrate may be a shape that is not a parallelogram, as in FIG. 13. FIG. 13 illustrates an example in which the ends of print element substrates at a connecting part have a stepped shape. In the case of a stepped shape, because a region lacking a print element and a circuit for an end portion of a print element substrate is smaller in comparison to a parallelogram shape, it is possible to have the distance between print elements that form a connection be even shorter.

In addition, there is no need for the number of print elements that form a connection between print element substrates to be one, and it may be zero or a plurality in accordance with an array pitch of the print elements. For the configuration of the present embodiment, because a distance by which print element substrates are shifted is shorter in comparison to the configuration of FIG. 7A and FIG. 7B, it is possible to also have print element substrates be closer in an x axis direction while shortening the distance between furthest end print elements that form a connection, and thus it is possible to increase the number of print elements that form a connection.

Third Embodiment

Figure 14A:
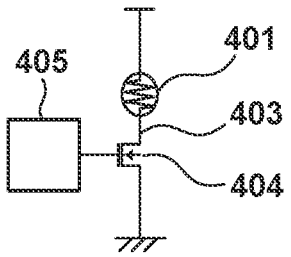
FIGS. 14A, 14B, 14C, and 14D are examples of configurations and layout views of print elements and driving circuits according to a third embodiment.
Figure 14B:
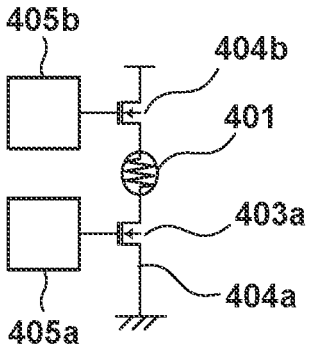
Figure 14C:
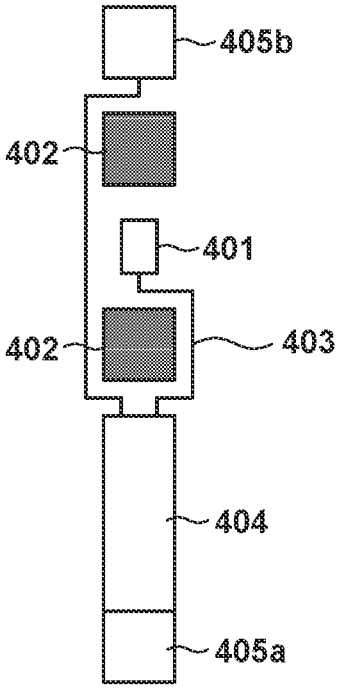

Explanation is given below regarding a third embodiment of the present application invention. FIG. 14A to FIG. 14D illustrate and example configurations and layout views of a print element and a print element driving circuit according to the present embodiment. A configuration that is the same as that of FIGS. 3A to 3C is denoted by the same reference numeral, and explanation thereof is omitted. In FIG. 14B, print element selection circuits 405*a* and 405*b* are arranged on two sides of the print element 401. In addition, in FIG. 14C and FIG. 14D, MOS transistors 404*a* and 404*b* are connected on two sides of the print element 401, and print element selection circuits 405*a* and 405*b* are respectively connected to the MOS transistors 404*a* and 404*b*. In this case, corresponding driving circuits are arranged on two sides of the print element.

Figure 14D:
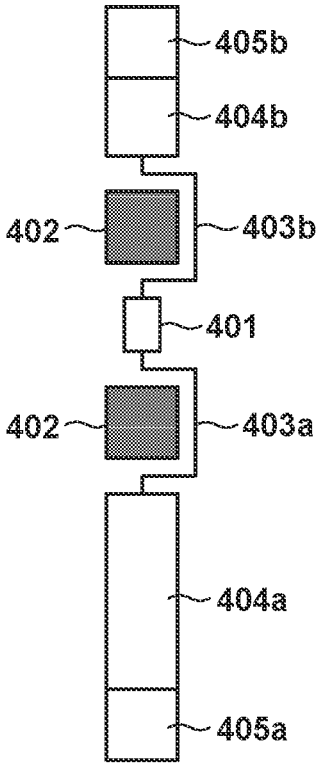
Figure 15A:
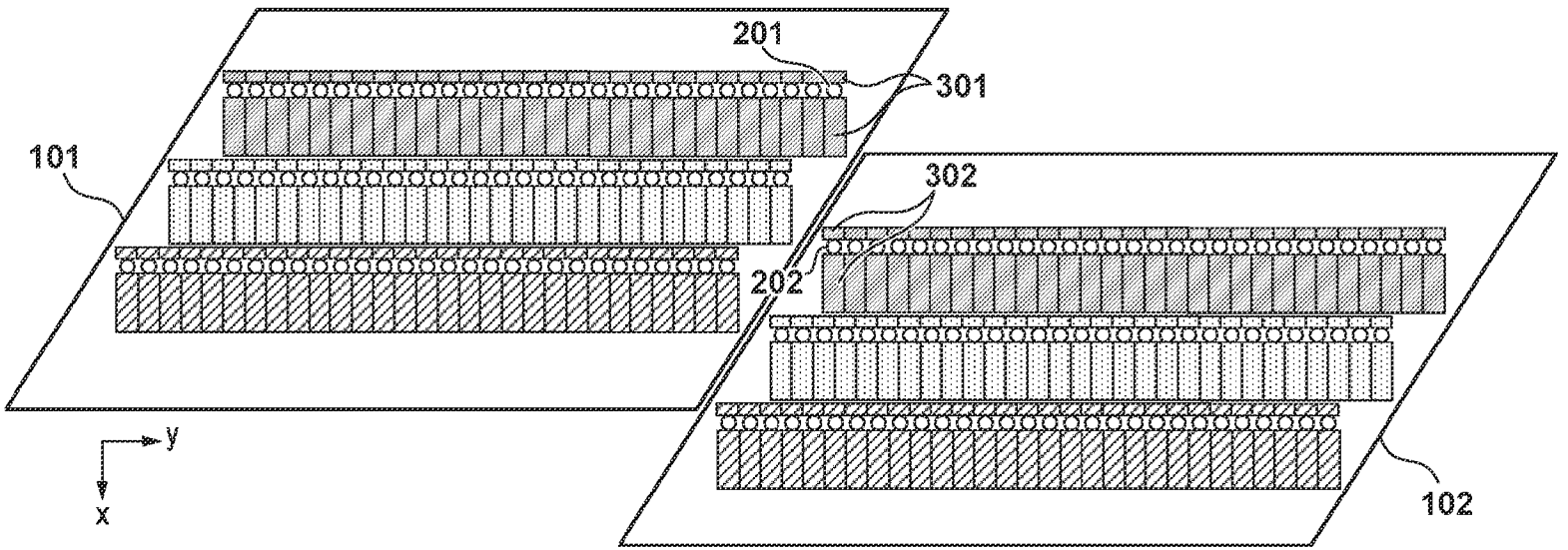
FIGS. 15A and 15B are views illustrating an example of a configuration of a printhead according to the third embodiment.
Figure 15B:
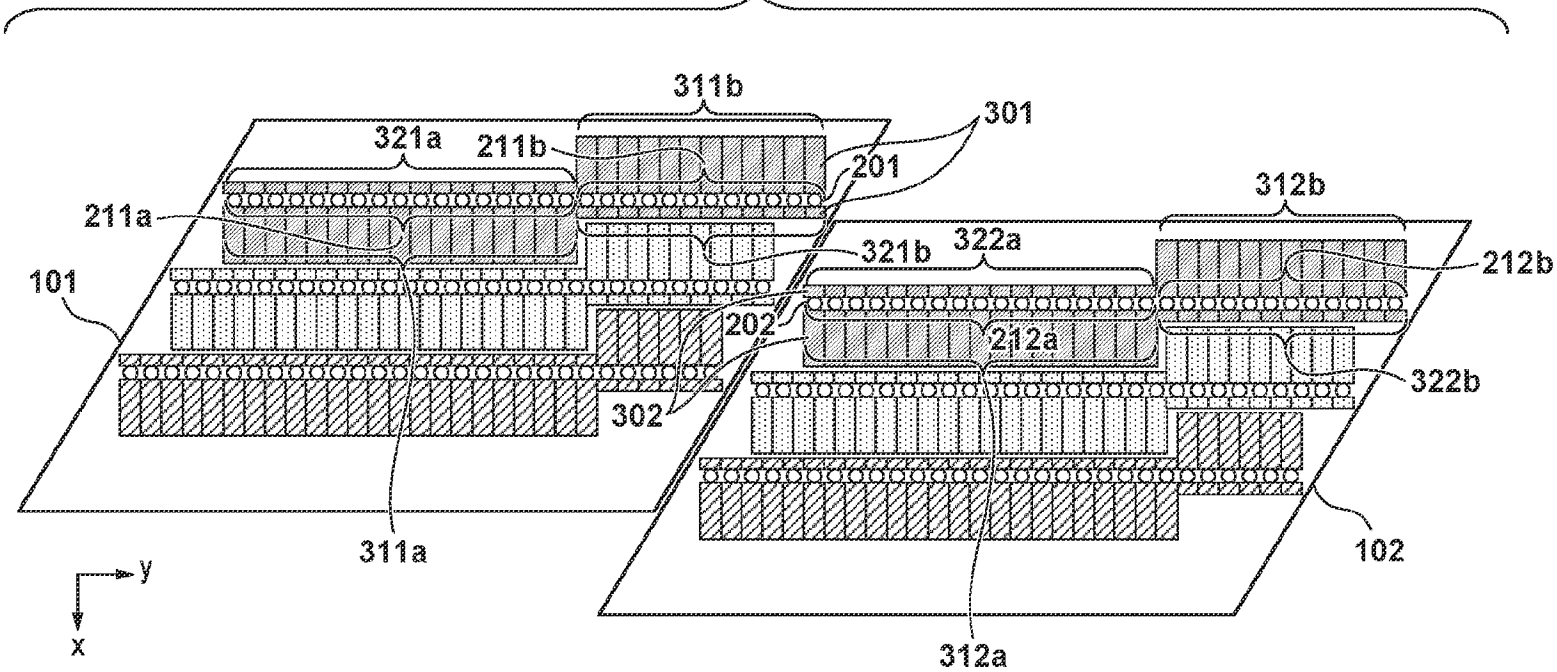

FIG. 15B illustrates an example of a configuration of a printhead according to the present embodiment. In addition, FIG. 15A illustrates a comparative example as a conventional example. A configuration that is the same as that of FIG. 6A and FIG. 6B is denoted by the same reference numeral, and explanation thereof is omitted. In the present embodiment, a driving circuit corresponding to each print element is arranged on both sides in the x axis direction (positive side and negative side with respect to the print element, as explained by FIG. 14A through FIG. 14D. In the present embodiment, the driving circuit is also arrayed so that the print element of an end portion can be close to the end of the print element substrate, similarly to in the first embodiment. In other words, the driving circuit is configured from two portions: a first portion having a large size and a second portion that is smaller in size than the first portion, and a corresponding print element is arranged to be sandwiched between these two portions.

Specifically, in the print element group 212*a*, a portion 312*a* for which a width in the x direction of the driving circuit is large is arranged in the positive x direction from the furthest end print element 202. The portion 312*a* corresponds to either of the MOS transistor 404 and the print element selection circuit 405*a* of FIG. 14B, or the MOS transistor 404*a* and the print element selection circuit 405*a* of FIG. 14D. In contrast, a portion 322*a* for which a width in the x direction of the driving circuit is small is arranged in the negative x direction from the furthest end print element 202. The portion 322*a* corresponds to either of the print element selection circuit 405*b* of FIG. 14B, or the MOS transistor 404*b* and the print element selection circuit 405*b* of FIG. 14D. By this, it is possible to have the furthest end print element 202 be close to the end of the print element substrate.

Similarly, in the print element group 211*b*, a driving circuit group 311*b* that is a portion for which a width in the x direction of driving circuits is large is arranged in the negative x direction from the furthest end print element 201, and a portion 321*b* for which a width in the x direction of driving circuits is small is arranged in a positive x direction from the furthest end print element 201. By this configuration, it is possible to have the furthest end print element 201 be close to the end of the print element substrate.

Note that there is no need for the arrangement of a MOS transistor and a print element selection circuit in the driving circuit 301 corresponding to the furthest end print element 201 to be the same as the arrangement of a MOS transistor and a print element selection circuit in the driving circuit 302 corresponding to the furthest end print element 202. For example, the print element selection circuits 405*a* and 405*b* illustrated in FIG. 14B may have an arrangement in which they are switched to opposite sides with respect to a print element in the furthest end print elements 201 and 202. In addition, regarding FIG. 14D, configuration may be taken such that the same circuit arrangement as FIG. 14D is used in the furthest end print element 201, and the print element selection circuits 405*a* and 405*b* are arranged on the side of the MOS transistor 404*a* in the furthest end print element 202.

By virtue of the present embodiment, by making the furthest end print element 201 and the furthest end print element 202 closer, an ink landing position deviation amount due to air flow at the time of printing is reduced, and it is also possible to suppress landing position deviation even in a case in which a medium to be printed to is conveyed diagonally with respect to a print element array. Note that there is no limitation to the circuit configuration and layout of FIG. 14A through FIG. 14D, and, for example, in a circuit configuration that is subject to time-divisional driving, the MOS transistor 404*a* or 404*b* may be shared with each group that configures a time-division.

Fourth Embodiment

Figure 16A:
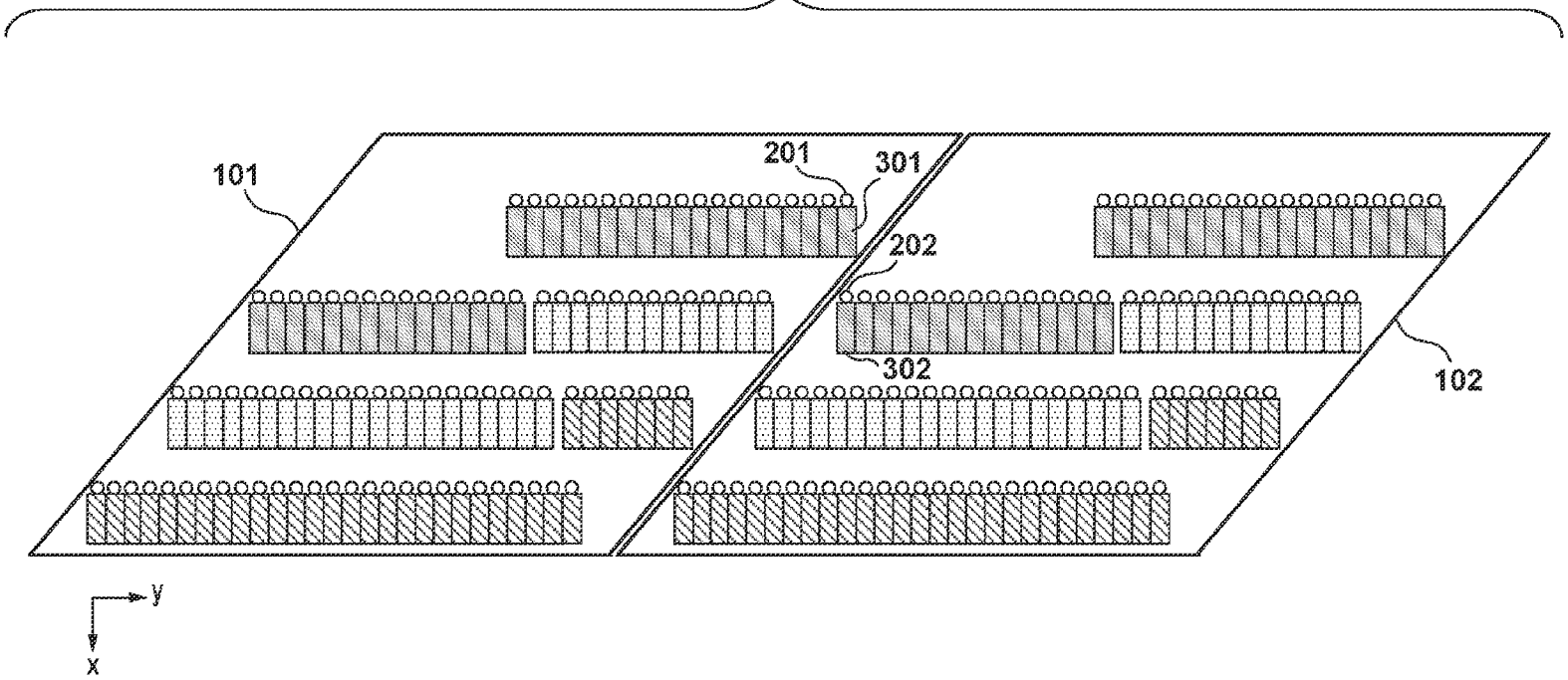
FIGS. 16A and 16B are views illustrating an example of a configuration of a printhead according to a fourth embodiment.
Figure 16B:
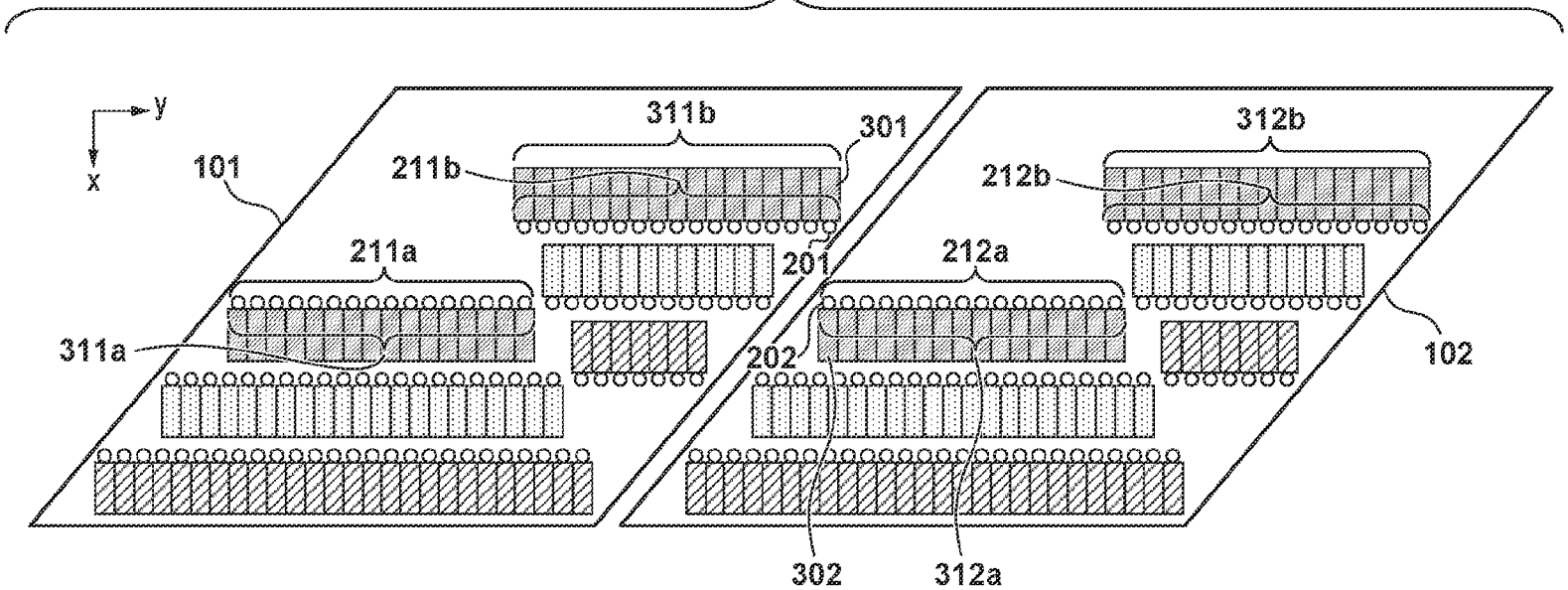

Explanation is given below regarding a fourth embodiment of the present application invention. FIG. 16B illustrates an example of a configuration of a printhead according to the present embodiment. In addition, FIG. 16A illustrates a comparative example as a conventional example. A configuration that is the same as that of FIG. 6A and FIG. 6B is denoted by the same reference numeral, and explanation thereof is omitted. The print element group 211*a* of the print element substrate 101 is offset in the print direction (x direction) part way through. Printing across a print width is possible by connecting the offsetted print element group 211*b* to the print element group 212*a* of the adjacent print element substrate 102.

Similarly to in the first embodiment, the driving circuit group 311*a* is arranged on the positive x axis side from the corresponding print element group 211*a*. Also, the driving circuit group 311*b* is arranged on the negative x axis side from the corresponding print element group 211*b*. Accordingly, on the right end (positive y axis side) of the print element substrate 101, because the driving circuit 301 is arranged more in the negative x direction than the furthest end print element 201, it is possible to make the furthest end print element 201 be closer to the end of the print element substrate.

Similarly, on the left end (negative y axis side) of the print element substrate 102, because the driving circuit 302 is arranged more in the positive x direction than the furthest end print element 202, it is possible to make the furthest end print element 202 be closer to the end of the print element substrate.

By virtue of the present embodiment, by making the furthest end print element 201 and the furthest end print element 202 that form a connection between print element substrates close, an ink landing position deviation amount due to air flow at a time of printing is reduced. In addition, it is possible to suppress landing position deviation even in a case where a printing medium is conveyed diagonally with respect to a print element array.

Other Embodiments

Explanation was given above regarding a first embodiment through a fourth embodiment for the present application invention, but there is no limitation to the forms described above. For example, as illustrated in FIG. 5A and FIG. 5B, array directions of the print element 201 and the driving circuit 301 are arranged orthogonally to the conveyance direction, but there is no limitation to this form. The array directions thereof may be arranged diagonally if it is a form that intersects the conveyance direction.

Figure 18A:
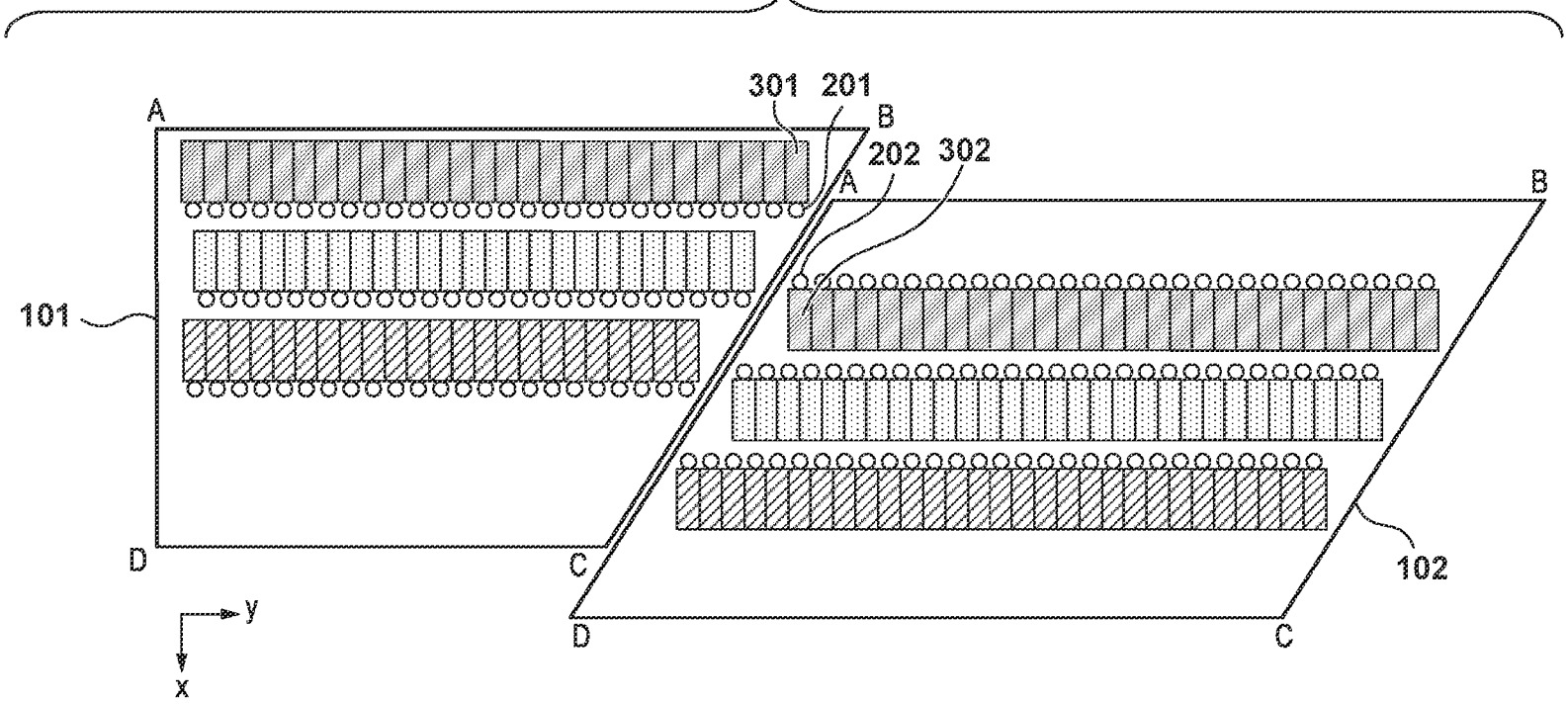
FIGS. 18A and 18B are views illustrating an example of a configuration of a printhead according to another embodiment.
Figure 18B:
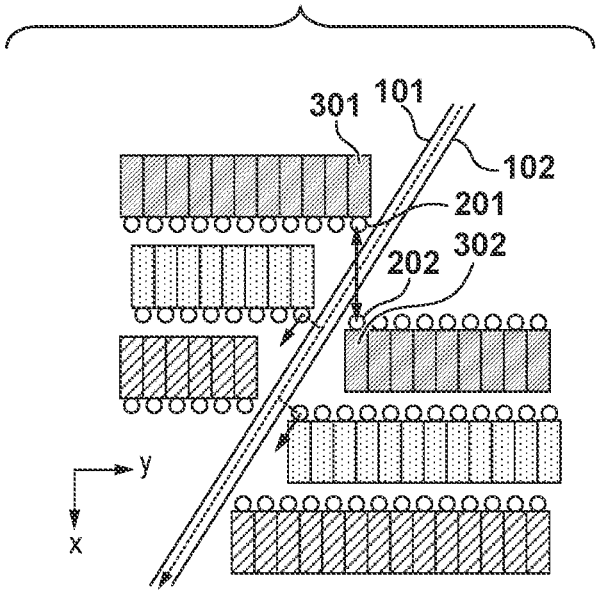
Figure 20:
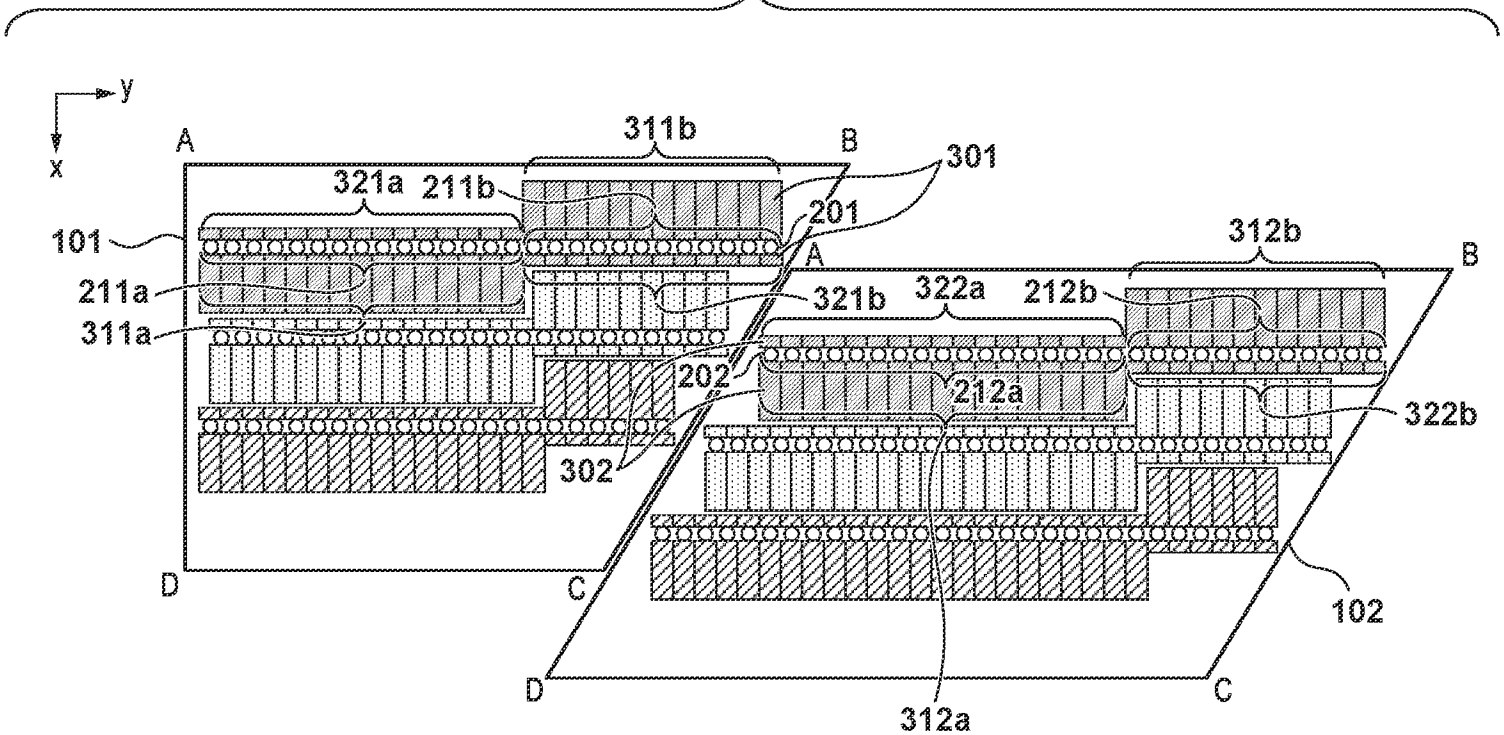
FIG. 20 is a view illustrating an example of a configuration of a printhead according to another embodiment.

Note that the form of an element substrate is not limited to the forms described above. For example, the print element substrate 101 can be applied to trapezoids as illustrated in FIG. 18A, FIG. 18B, and FIG. 20. In these trapezoids, the angle A and the angle D are right angles. The angle B is an acute angle and the angle C is an obtuse angle. In these trapezoids ABCD, the side AB and the side CD are parallel. In such a case, the print element substrate 102 is a parallelogram. A relation between the arrangements of the driving circuits 301 and 302 and the print elements 201 and 202 illustrated in FIGS. 18A and 18B or FIG. 20 is similar to that of the embodiments described above, and explanation thereof is omitted.

Figure 19A:
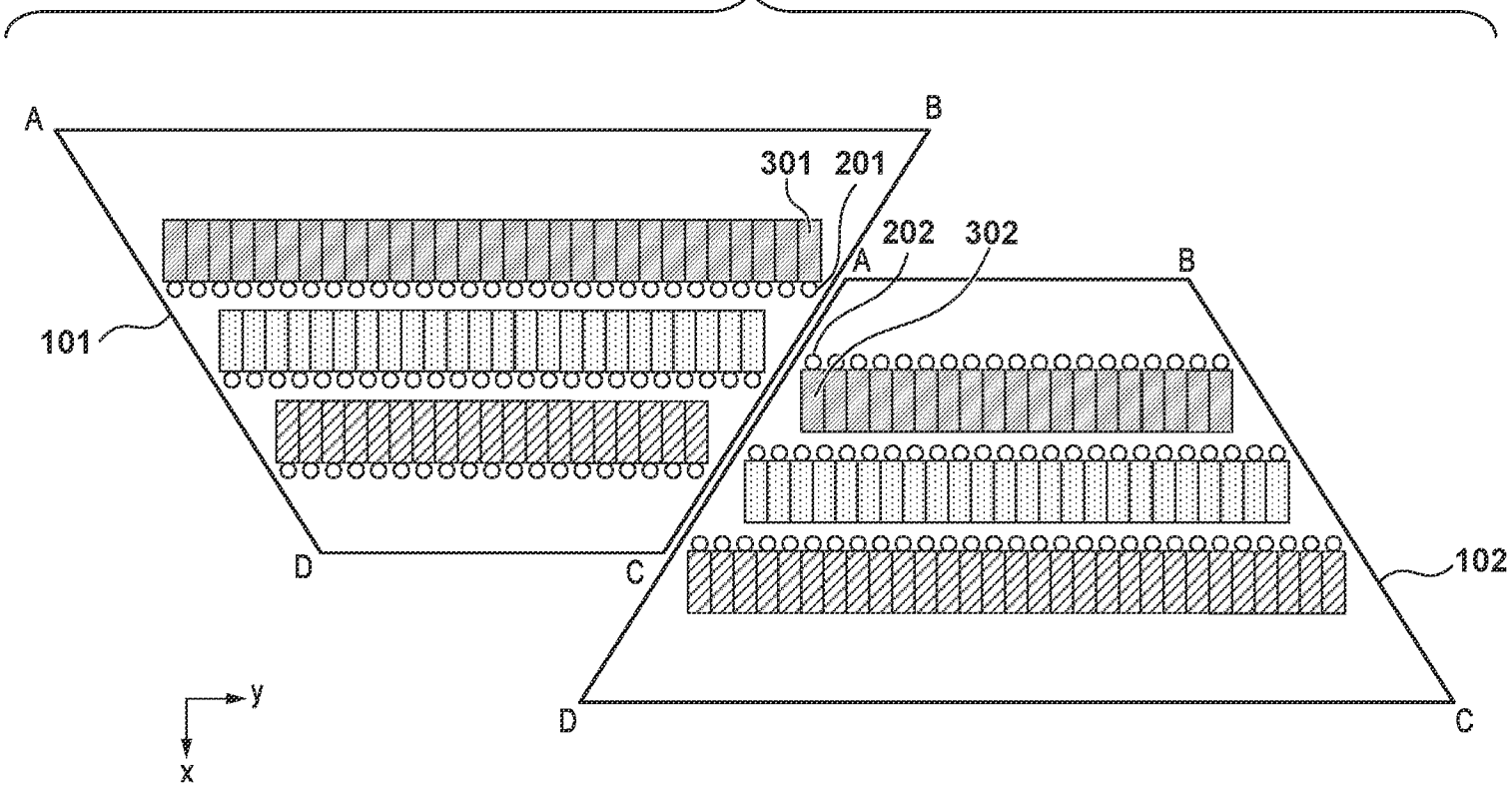
FIGS. 19A and 19B are views illustrating an example of a configuration of a printhead according to another embodiment.
Figure 19B:
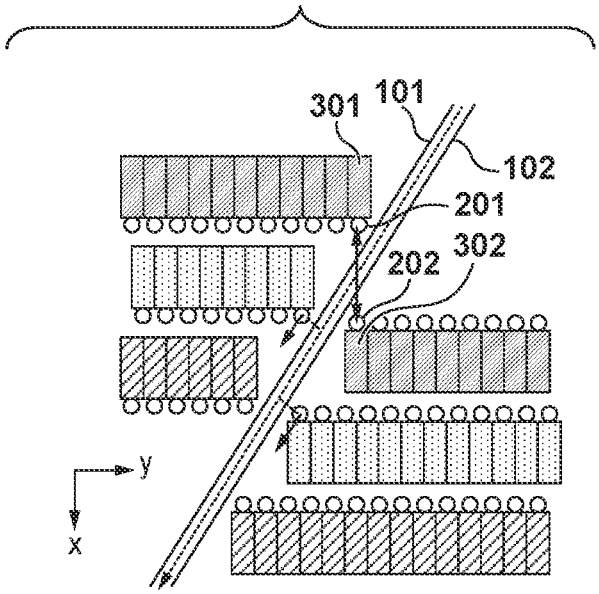
Figure 21:
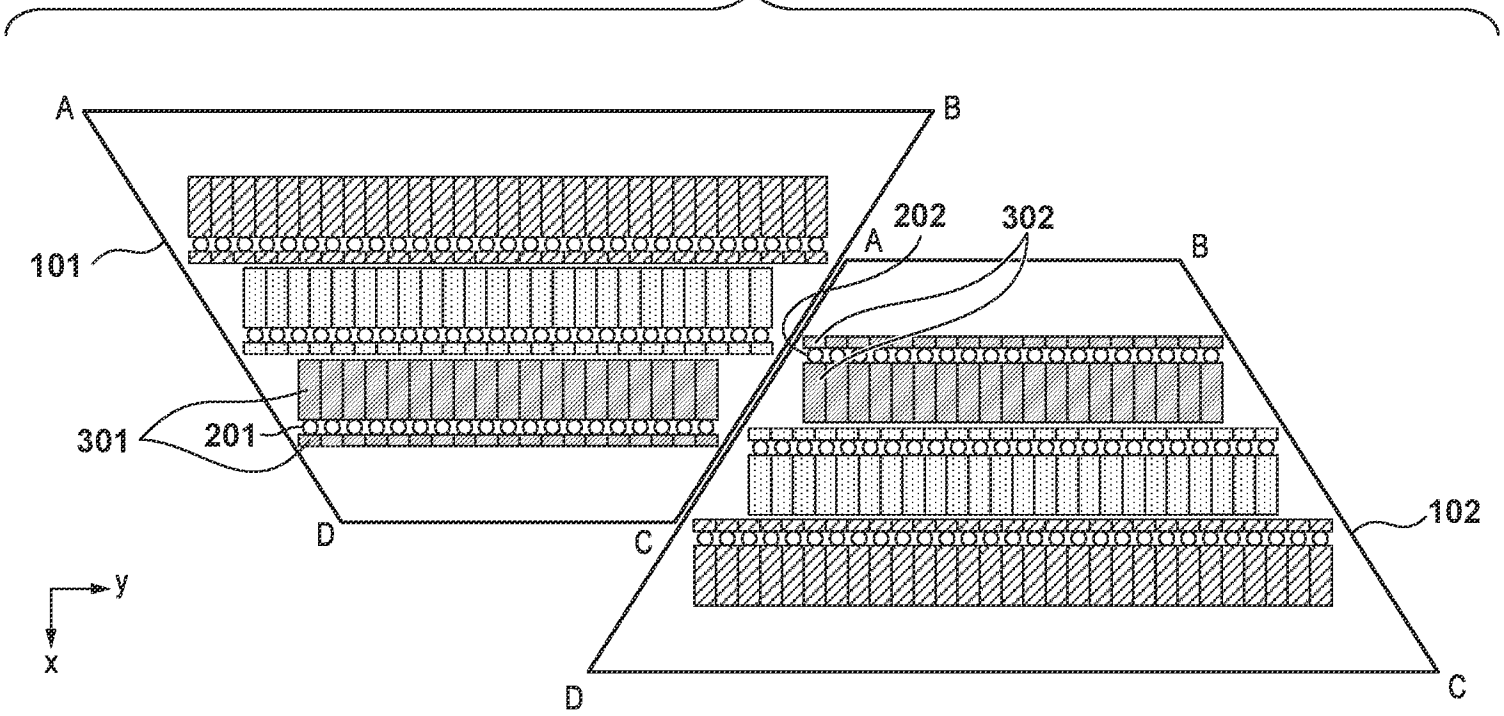
FIG. 21 is a view illustrating an example of a configuration of a printhead according to another embodiment.

In addition, the print element substrate 101 can be applied to trapezoids as illustrated in FIG. 19A, FIG. 19B, and FIG. 21. In these trapezoids, the angle A and the angle B are acute angles, and the angle C and the angle D are obtuse angles. In these trapezoids ABCD, the side AB and the side CD are parallel. In such a case, the print element substrate 102 is a trapezoid. Even if the print element substrates 101 and 102 are trapezoids, when focus is given to the positional relationship of the driving circuit 301 and the print element 201 with respect to the angle B and the angle C, it is similar to that in the embodiments described above, and explanation thereof is omitted.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-188751, filed Sep. 27, 2016, which is hereby incorporated by reference herein in its entirety.

What is claimed is:

1. A printhead comprising:

a plurality of element substrates that each include a first element substrate adjacent to a second element substrate in a first direction, wherein a planar shape of each of the first element substrate and the second element substrate is quadrilateral that has a first side and a second side along the first direction, wherein the quadrilateral of the first element substrate has a first element substrate oblique side close to the second element substrate, the first element substrate oblique side obliquely intersecting with both of the first side and the second side of the first element substrate, wherein the quadrilateral of the second element substrate has a second element substrate oblique side close to the first element substrate side, the second element substrate oblique side obliquely intersecting with both of the first side and the second side of the second element, wherein the first element substrate and the second element substrate each have a print element array in which a plurality of print elements are arrayed in the first direction, and each have a plurality of driving circuits that respectively correspond to the plurality of print elements, each corresponding print element and driving circuit being arranged in a second direction that intersects with both of the first direction and a third direction along the first element substrate oblique side and along the second element substrate oblique side, and each of the plurality of driving circuits being arranged on either a side of the first side or a side of the second side with respect to a print element corresponding to a driving circuit, wherein a first print element array arranged in the first element substrate includes a first print element that is closest to the second element substrate in the first direction, and a second print element array arranged in the second element substrate includes a second print element that is closest to the first element substrate in the first direction, and wherein an order of arrangement in the second direction of at least the first print element and a first driving circuit corresponding to the first print element is opposite to an order of arrangement in the second direction of the second print element and a second driving circuit corresponding to the second print element.

2. The printhead according to claim 1, wherein the first print element and the first driving circuit are arranged in an order of the first driving circuit and then the first print element in the second direction, and the second print element and the second driving-circuit are arranged in an order of the second print element and then the second driving circuit in the second direction.

3. The printhead according to claim 1, wherein each of the first driving circuit and the second driving circuit has a first circuit unit and a second circuit unit having a smaller area than that of the first circuit unit, in the first element substrate, the first print element, the first circuit unit and the second circuit unit are arranged in the order of the first circuit unit, the print element, and then the second circuit unit in the second direction, and in the second element substrate, the second print element, the first circuit unit and the second circuit unit are arranged in the order of the second circuit unit, the print element, and then the first circuit unit in the second direction.

4. The printhead according to claim 1, wherein in the first element substrate, the quadrilateral has an acute angle portion between the first side and the first element substrate oblique side, and an obtuse angle portion between the second side and the first element substrate oblique side, and in the second direction, the first print element is arranged on a side of the obtuse angle portion, and the first driving circuit is arranged on a side of the acute angle portion.

5. The printhead according to claim 1, wherein in the second element substrate, the quadrilateral has an obtuse angle portion between the first side and the second element substrate oblique side, and an acute angle portion between the second side and the second element substrate oblique side, and in the second direction, the second print element is arranged on a side of the obtuse angle portion, and the second driving circuit is arranged on a side of the acute angle portion.

6. The printhead according to claim 1, wherein the planar shape of the first and second element substrates is either a parallelogram or a trapezoid.

7. The printhead according to claim 1, wherein the first element substrate and the second element substrate each have a plurality of print element arrays in which a plurality of print elements are arranged in the first direction, and the first element substrate and the second element substrate each have a plurality of driving circuits that respectively correspond to the plurality of print elements included in the plurality of print element arrays.

8. An element substrate comprising:

a print element array in which a plurality of print elements in a first direction; and a plurality of driving circuits respectively corresponding to the plurality of print elements arrayed in the first direction, wherein a planar shape of the element substrate is quadrilateral that has a first side and a second side along the first direction and an oblique side that obliquely intersects with the first direction, wherein each corresponding print element and driving circuit are arranged in a second direction that intersects with both the first direction and a third direction along the oblique side, wherein the quadrilateral has an acute angle portion between the first side and the oblique side, and an obtuse angle portion between the second side and the oblique side, each of the plurality of driving circuits being arranged on either a side of the first side or a side of the second side with respect to a print element corresponding to a driving circuit, wherein a print element, out of the print elements included in the print element array, closest to the second side in the first direction is arranged on a side of the obtuse angle portion in the second direction, and wherein a driving circuit corresponding to the print element closest to the second side is arranged on a side of the acute angle portion in the second direction.

9. The element substrate according to claim 8, wherein the planar shape of the element substrate is either a parallelogram or a trapezoid.

10. A printing apparatus comprising:

a conveying unit configured to convey a printing medium; and a printhead configured to print an image to the printing medium, wherein the printhead has a plurality of element substrates including a first element substrate adjacent and a second element substrate in a predetermined direction that intersects with a conveyance direction in which the printing medium is conveyed, wherein a planar shape of each of the first element substrate and the second element substrate is quadrilateral that has a first side and a second side along the predetermined direction, wherein the quadrilateral of the first element substrate has a first element substrate oblique side close to the second element substrate, the first element substrate oblique side obliquely intersecting with both of the first side and the second side of the first element substrate, wherein the quadrilateral of the second element substrate has a second element substrate oblique side close to the first element substrate side, the second element substrate oblique side obliquely intersecting with both of the first side and the second side of the second element, wherein the first element substrate and the second element substrate each have a print element array in which a plurality of print elements in the predetermined direction, and each have a plurality of driving circuits that respectively correspond to the plurality of print elements, each corresponding print element and driving circuit being arranged in the conveyance direction that intersects with both of the predetermined direction and another direction along the first element substrate oblique side and along the second element substrate oblique side, and each of the plurality of driving circuits being arranged on either a side of the first side or a side of the second side with respect to a print element corresponding to a driving circuit, wherein a first print element array arranged in the first element substrate includes a first print element that is closest to the second element substrate in the predetermined direction, and a second print element array arranged in the second element substrate includes a second print element that is closest to the first element substrate in the predetermined direction, and wherein an order of arrangement in the conveyance direction of at least the first print element and a first driving circuit corresponding to the first print element is opposite to an order of arrangement in the conveyance direction of the second print element and a second driving circuit corresponding to the second print element.

11. The printing apparatus according to claim 10, wherein the first print element and the first driving circuit are arranged in an order of the first driving circuit and then the first print element in the conveyance direction, and the second print element and the second driving circuit are arranged in an order of the second print element and then the second driving circuit in the conveyance direction.

12. The printing apparatus according to claim 10, wherein in the first element substrate, the quadrilateral has an acute angle portion between the first side and the first element substrate oblique side, and an obtuse angle portion between the second side and the first element substrate oblique side, and in the conveyance direction, the first print element is arranged on a side of the obtuse angle portion, and the first driving circuit is arranged on a side of the acute angle portion.

13. The printing apparatus according to claim 10, wherein in the second element substrate, the quadrilateral has an obtuse angle portion between the first side and the second element substrate oblique side, and an acute angle portion between the second side and the second element substrate oblique side, in the conveyance direction, the second print element is arranged on a side of the obtuse angle portion, and the second driving circuit is arranged on a side of the acute angle portion.

14. The printhead according to claim 10, wherein the planar shape of the first and second element substrates is either a parallelogram or a trapezoid.

* * * * *